United States Patent [19]

Emoto et al.

[11] Patent Number: 4,631,242

[45] Date of Patent: Dec. 23, 1986

[54] BISAZO ELECTROPHOTOGRAPHIC SENSITIVE MATERIALS WITH —$CF_3$ GROUP

[75] Inventors: Kazuhiro Emoto; Kozo Haino; Akira Itoh, all of Nagaokakyo, Japan

[73] Assignee: Mitsubishi Paper Mills, Ltd., Tokyo, Japan

[21] Appl. No.: 772,878

[22] Filed: Sep. 5, 1985

[30] Foreign Application Priority Data

Sep. 13, 1984 [JP] Japan ..... 59-191992
Oct. 1, 1984 [JP] Japan ..... 59-206851
Oct. 2, 1984 [JP] Japan ..... 59-207631

[51] Int. Cl.[4] ..... G03G 5/06; G03G 5/14

[52] U.S. Cl. ..... 430/58; 430/70; 430/72; 430/73; 430/74; 430/75; 430/76; 430/77; 430/78; 430/79; 534/656; 534/689; 534/759; 534/760; 534/761; 534/763; 534/823

[58] Field of Search ..... 430/58, 59, 70, 72, 430/73, 74, 75, 76, 77, 78, 79

[56] References Cited

U.S. PATENT DOCUMENTS 4,400,455 8/1983 Hashimoto et al. ..... 430/59
4,481,271 11/1984 Hashimoto et al. ..... 430/59 X
4,540,643 9/1985 Tsutsui ..... 430/58

FOREIGN PATENT DOCUMENTS 59-99442 6/1984 Japan ..... 430/58

*Primary Examiner*—Roland E. Martin
*Attorney, Agent, or Firm*—Cushman, Darby & Cushman

[57] ABSTRACT

An electrophotographic sensitive material high in sensitivity and endurance comprises an electrically conductive support and a light-sensitive layer containing at least one of the azo compound represented by the general formulas [I]–[III]:

General formula [I]:

$$Cp_1—N=N—A—N=N—Cp_2$$

[wherein A represents a divalent residue which bonds through C atoms to N atoms which constitute azo and $Cp_1$ is a group represented by the formula:

(wherein Z represents a group of atoms necessary to form a substituted or unsubstituted carbocyclic aromatic ring, a substituted or unsubstituted heterocyclic aromatic ring or a unsaturated monocyclic hydrocarbon ring and R represents an aryl group containing one or two $CF_3$ groups) and $Cp_2$ is a coupler residue different from said $Cp_1$ and is selected from that represented by the following formulas (a)–(f):

(In the above formulas, $Z^1$ and $Z^2$ represent a group of atoms necessary to form a substituted or unsubstituted aromatic hydrocarbon ring or substituted or unsubstituted hetero ring, $R^1$ and $R^2$ represent substituted or unsubstituted alkyl, aralkyl, aryl or hetero ring group, $R^3$ represents an alkyl or carboxyl group or an ester thereof, $R^4$ and $R^6$ represent substituted or unsubstituted aryl or hetero ring group and $R^5$ represents H, a substituted or unsubstituted alkyl, aralkyl, aryl or hetero ring group and $Y^1$ and $Y^2$ represent —$NR^7R^8$, —$OR^9$, —NHN=CH—$R^{10}$ or —$NHNR^{11}R^{12}$ wherein $R^7$, $R^8$, $R^9$, $R^{11}$ and $R^{12}$ represent H, substituted or unsubstituted alkyl, aralkyl, aryl or hetero ring group and $R^{10}$ represents a substituted or unsubstituted aryl or hetero ring group.

General formula (II):

(Abstract continued on next page.)

-continued

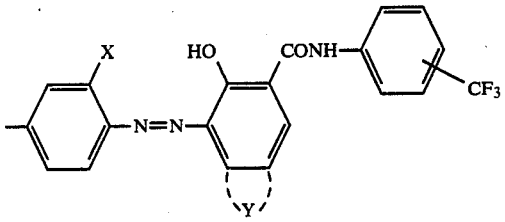

(wherein X represents H, a halogen atom, a lower alkyl group, methoxy group or nitro group and Y represents an aromatic ring or hetero ring which may be substituted).

General formula (III):

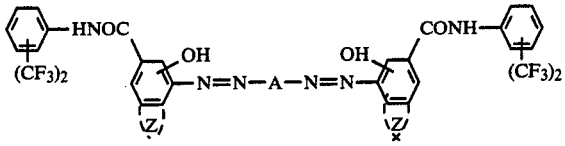

(wherein A represents a divalent residue which bonds through C atoms to N atoms which constitute azo and Z represents a group of atoms necessary to form a substituted or unsubstituted carbocyclic aromatic ring, a substituted or unsubstituted heterocyclic aromatic ring or unsaturated monocyclic hydrocarbon ring).

6 Claims, No Drawings

BISAZO ELECTROPHOTOGRAPHIC SENSITIVE MATERIALS WITH —$CF_3$ GROUP

FIELD OF THE INVENTION

This invention relates to electrophotographic sensitive materials and more particularly to electrophotographic sensitive materials having a lightsensitive layer containing a bis-azo pigment on an electrically conductive support.

BACKGROUND OF THE INVENTION

In a light-sensitive layer of conventional electrophotographic sensitive materials inorganic photoconductive substances such as selenium, cadmium sulfide, zinc oxide and the like have been widely used. In recent years research has been in progress on the use of organic photoconductive substances and some are practically used for electrophotographic sensitive materials.

Generally speaking, organic photoconductive substances have advantages over inorganic photoconductive substances in higher transparency, lighter weight, better film-forming ability and flexibility and easier design of sensitive materials using proper sensitizing methods.

Fundamental properties required for electrophotographic sensitive materials include (1) high chargeability when exposed to corona discharge in the darkness, (2) less leakage, in the dark, of the charge obtained (decay in the dark), (3) rapid release of the charge when exposed to light (decay with light) and (4) little residual charge after exposure to light.

Many researches have been made on photoconductive polymers such as polyvinylcarbazole to be used as organic photoconductive substances. These compounds, however, are not satisfactory in film-forming properties, flexibility and adhesiveness and are difficult to fully meet the above mentioned fundamental requirements. On the other hand, electrophotographic sensitive materials excellent in mechanical properties can be obtained with organic low molecular photoconductive compounds if polymers excellent in film-forming properties, flexibility, adhesiveness, etc. are selected as binders, but it has been difficult to find compounds suitable to produce sensitive materials of high sensitivity.

Recently, electrophotographic sensitive materials in which a specific mono-azo compound or bis-azo compound is used as photoconductive substance are proposed, for example, in Japanese Patent Unexamined Publications (Kokai) No. 37543/72 and No. 119926/79. These compounds, however, are not sufficient to improve sensitivity of sensitive materials and further improvement of sensitivity has been desired.

SUMMARY OF THE INVENTION

The inventors have made intensive researches on organic low-molecular photoconductive compounds which can provide electrophotographic sensitive materials of high sensitivity and high endurance and have found that some bis-azo pigments are suitable for this purpose.

Accordingly, the object of this invention is to provide electrophotographic sensitive materials of high sensitivity and high endurance.

Another object of this invention is to provide electrophotographic sensitive materials containing an azo compound capable of effectively acting as a carrier generating substance even in combination with a wide variety of carrier transport substances.

DETAILED DESCRIPTION OF THE INVENTION

As a result of the inventors' intensive researches in an attempt to attain the above objects, it has been found that azo compounds represented by the following general formulas (I)–(III) can serve as an effective component of electrophotographic sensitive materials.

General formula (I):

$$C_{p1}\text{-}N{=}N\text{-}A\text{-}N{=}N\text{-}C_{p2}$$

[wherein A represents a divalent residue which bonds through its C atoms to N atoms which constitute azo, $C_{p1}$ and $C_{p2}$ are different groups and $C_{p1}$ is a group represented by the formula

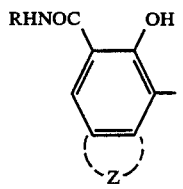

(wherein Z represents a group of atoms necessary to form a substituted or unsubstituted carbocyclic aromatic ring, a substituted or unsubstituted heterocyclic aromatic ring or unsaturated monocyclic hydrocarbon ring and R represents an aryl group containing one or two $CF_3$ groups)].

$Cp_2$ is a coupler residue difference from said $Cp_1$ and can be selected, for example, from the following (a) - (f).

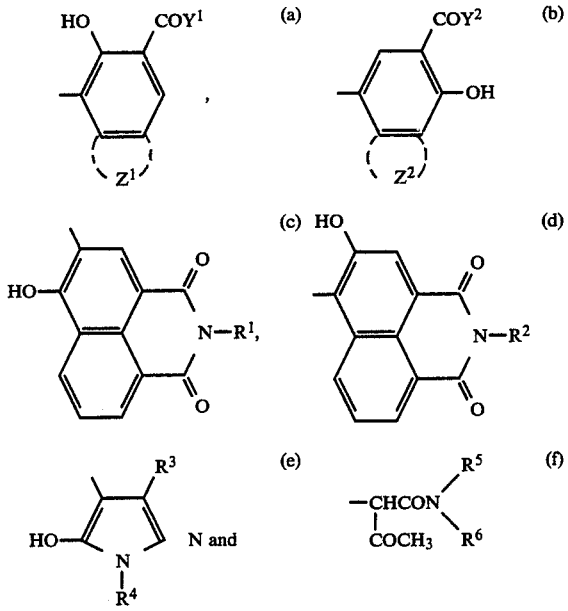

(In the above formulas, $Z^1$ and $Z^2$ represent a group of atoms necessary to form a substituted or unsubstituted aromatic hydrocarbon ring or a substituted or unsubstituted heterocyclic ring, $R^1$ and $R^2$ represent substituted or unsubstituted alkyl, aralkyl, aryl or heterocyclic group, $R^3$ represents an alkyl or carboxyl group or an ester thereof, $R^4$ and $R^6$ represent substituted or unsubstituted aryl or hetero ring group and $R^5$ represents H, a substituted or unsubstituted alkyl, aralkyl, aryl or heterocyclic group and $Y^1$ and $Y^2$ represent $-NR^7R^8$, $-OR^9$, $-NHN=CH-R^{10}$, or $NHNR^{11}R^{12}$ wherein $R^7$, $R^8$, $R^9$, $R^{11}$ and $R^{12}$ represent H, substituted or unsubstituted alkyl, aralkyl, aryl or hetero ring group and $R^{10}$ represents a substituted or unsubstituted aryl or heterocyclic group. General formula (II):

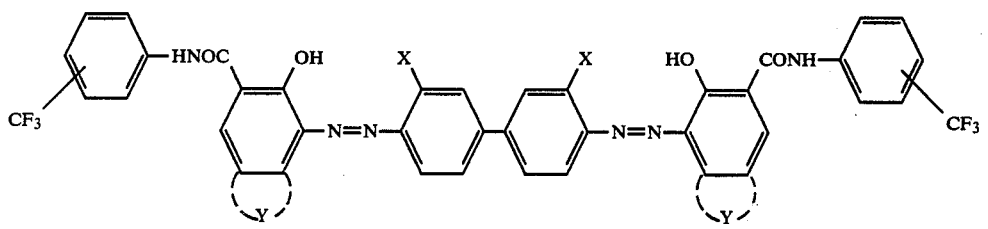

(II)

(wherein X represents H, a halogen atom, a lower alkyl group, methoxy group or nitro group and Y represents an aromatic ring or heterocyclic ring which may be substituted).

General formula (III):

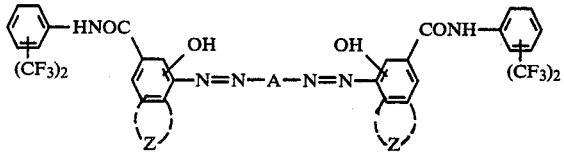

(III)

(wherein A represents a divalent residue which bonds through its C atoms to N atoms which constitute azo and Z represents a group of atoms necessary to form a substituted or unsubstituted carbocyclic aromatic ring, a substituted or unsubstituted heterocyclic aromatic ring or an unsaturated monocyclic hydrocarbon ring).

That is, according to this invention an electrophotographic sensitive material excellent in film-forming ability and electrophotographic characteristics such as charge maintenenace, sensitivity, residual potential, etc. shows less fatigue deterioration upon repeated use and no variations of said characteristics due to heat or light and capable of displaying stable characteristics can be provided by using the azo compound represented by the aforementioned general formula [I], [II], or [III] as a photoconductive substance which constitutes the light-sensitive layer of the electrophotographic sensitive material, or using the azo compound as a carrier generation substance of the so-called function-separated type electrophotographic sensitive material which performs generation and transport of carrier by separate substances by utilizing only the excellent carrier generating ability of the azo compound.

As unlimiting examples of azo compounds useful in this invention which are represented by said general formulas (I) - (III), mention may be made of those which have the following structural formulas. Compounds represented by the general formula [I]

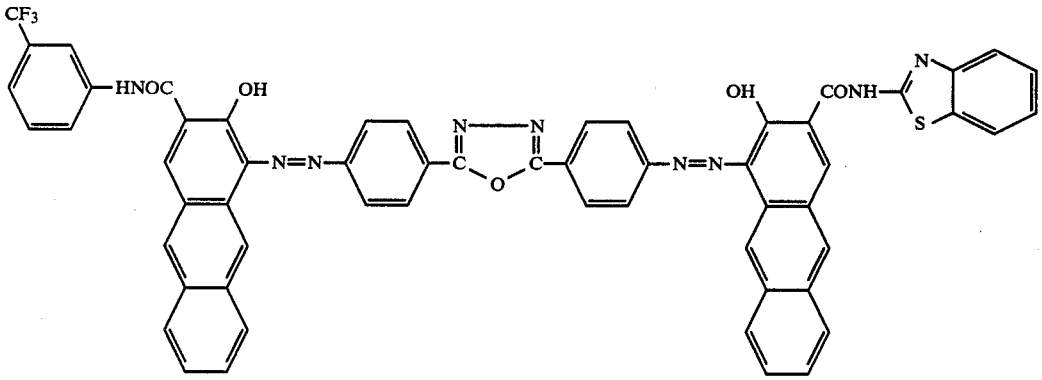

[I]-(1)

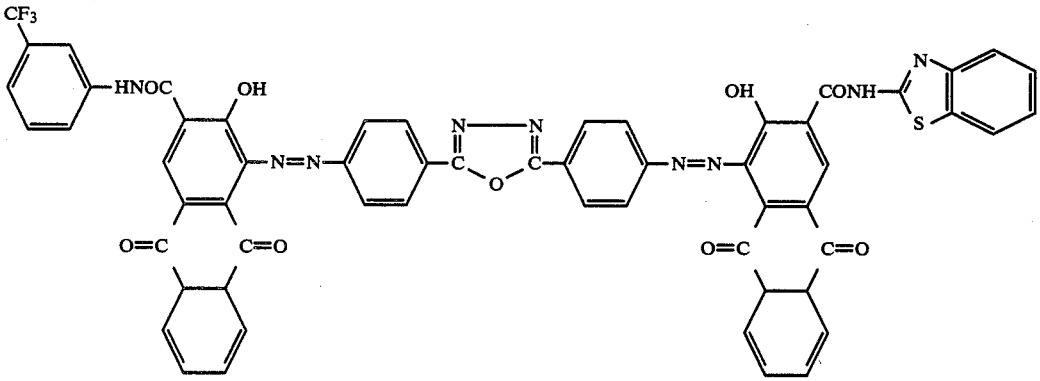

[I]-(2)

-continued
[I]-(3)
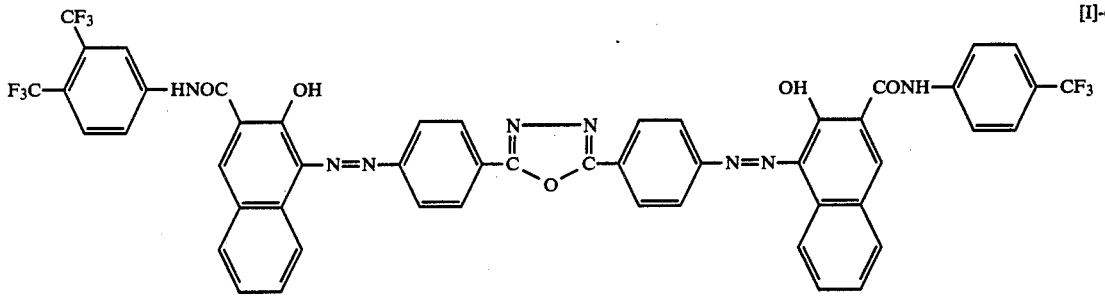
[I]-(4)
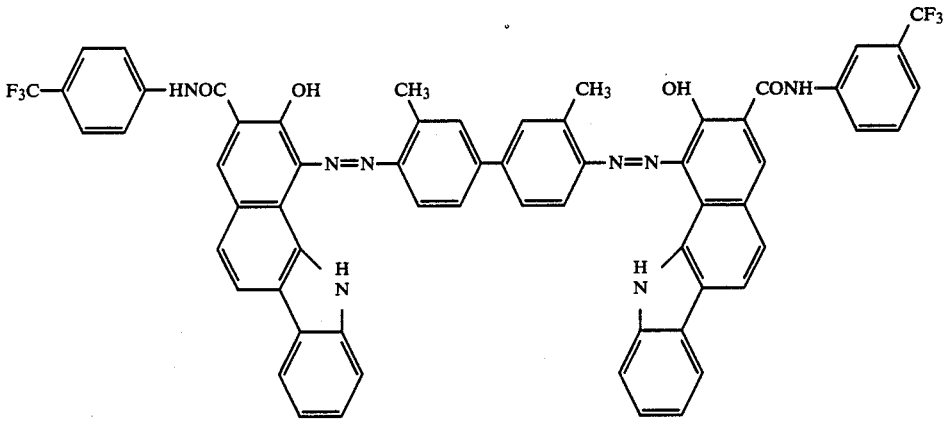
[I]-(5)
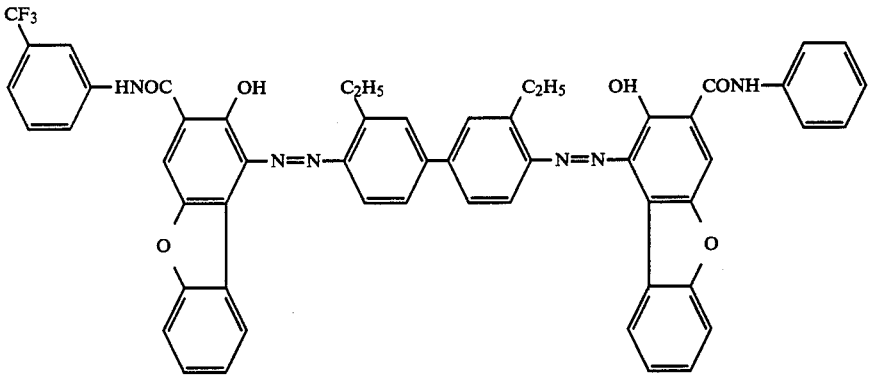
[I]-(6)
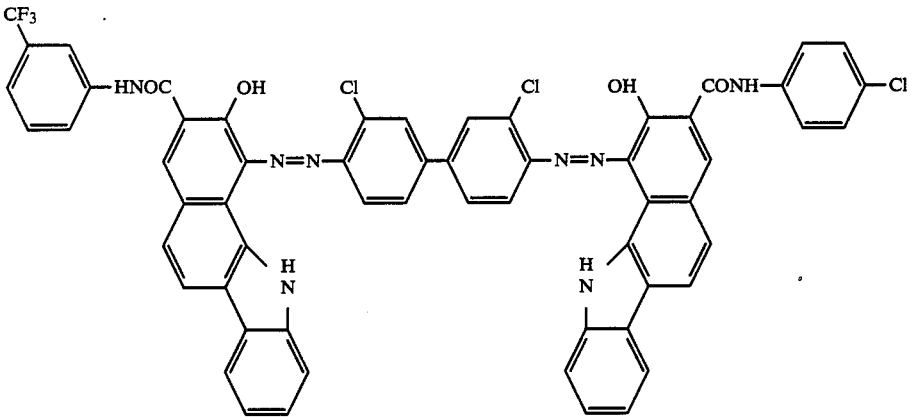

-continued
[I]-(7)
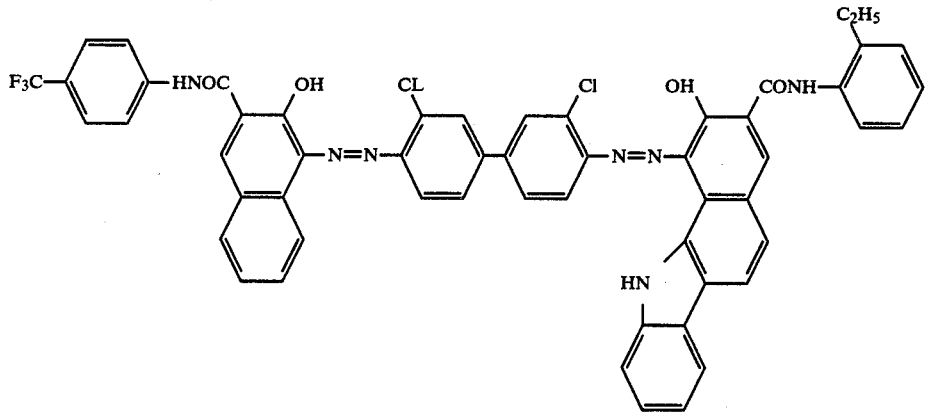
[I]-(8)
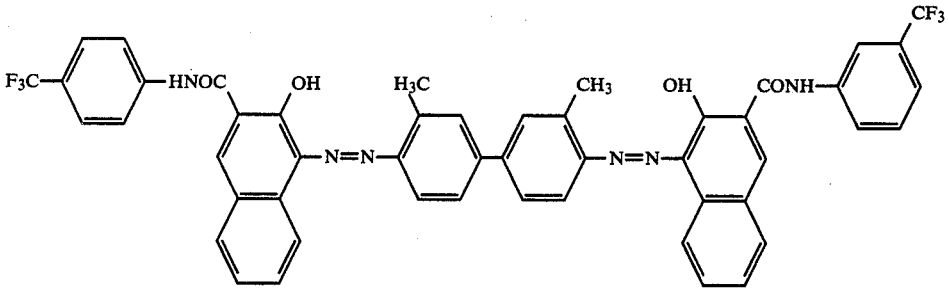
[I]-(9)
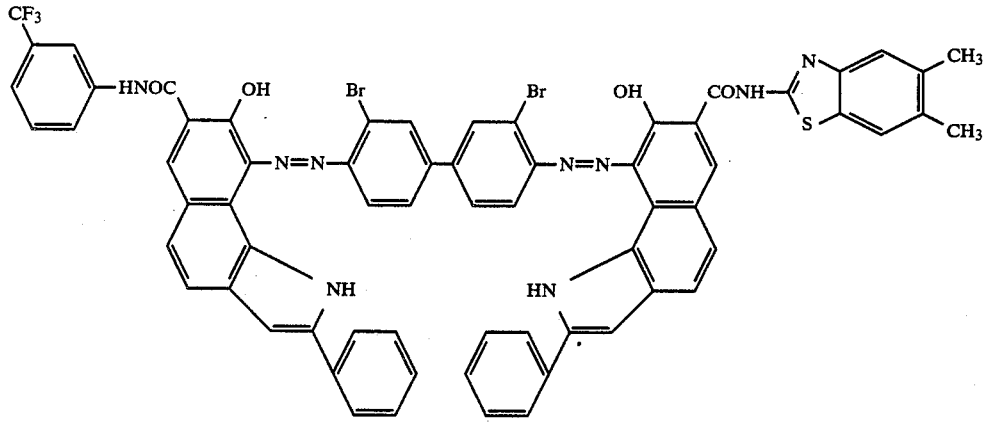
[I]-(10)
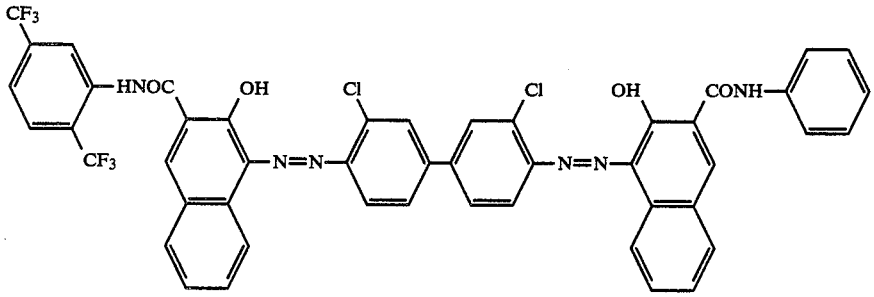

-continued
[I]-(11)
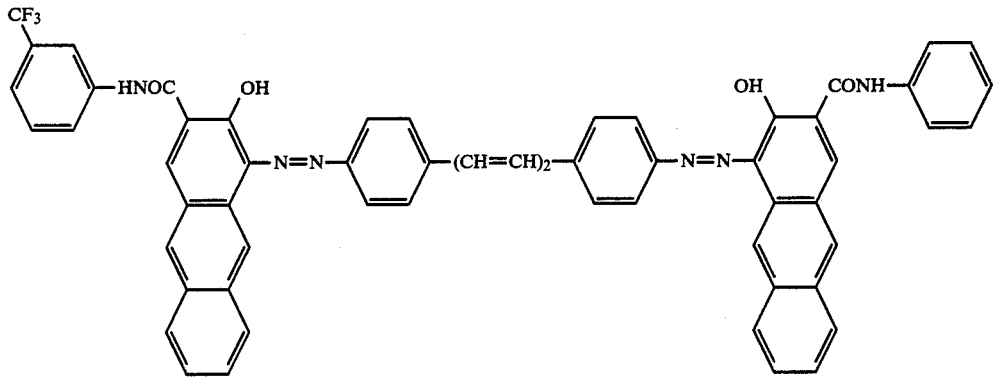
[I]-(12)
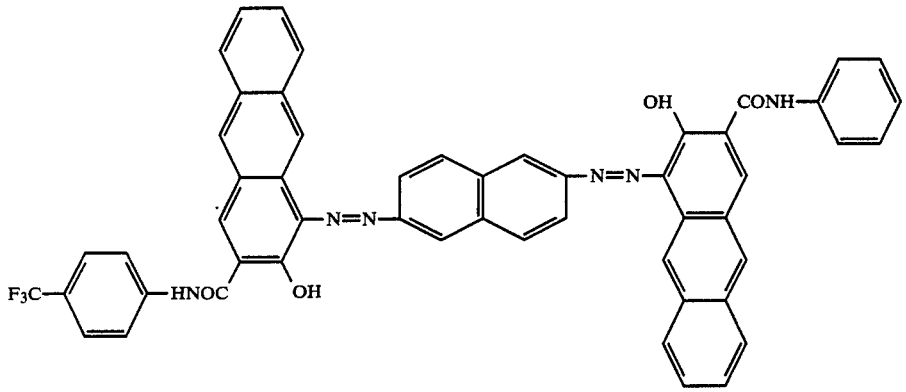
[I]-(13)
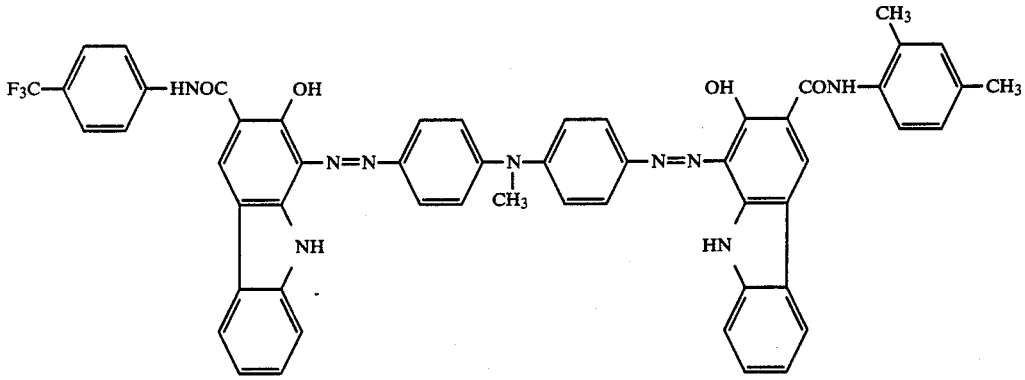
[I]-(14)
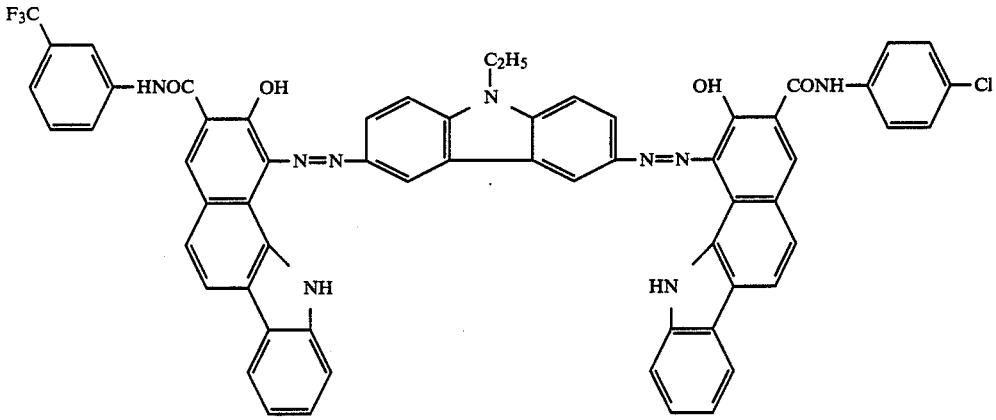

-continued
[I]-(15)
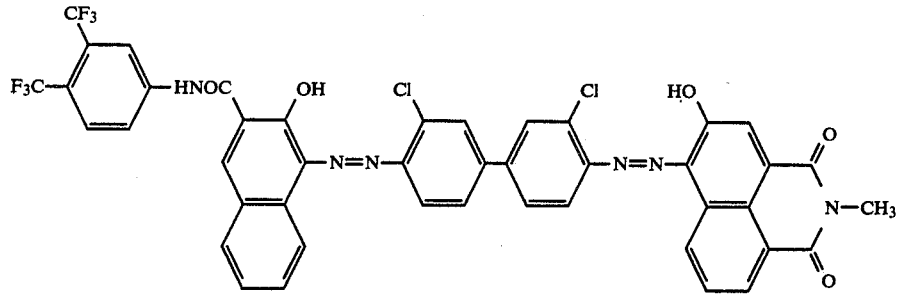
[I]-(16)
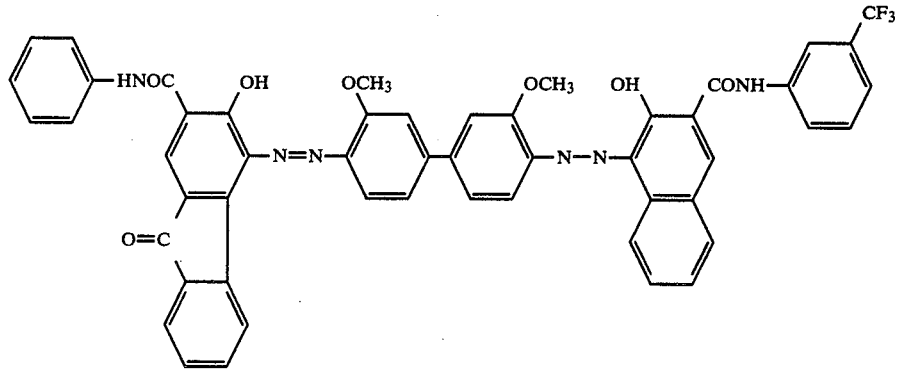
[I]-(17)
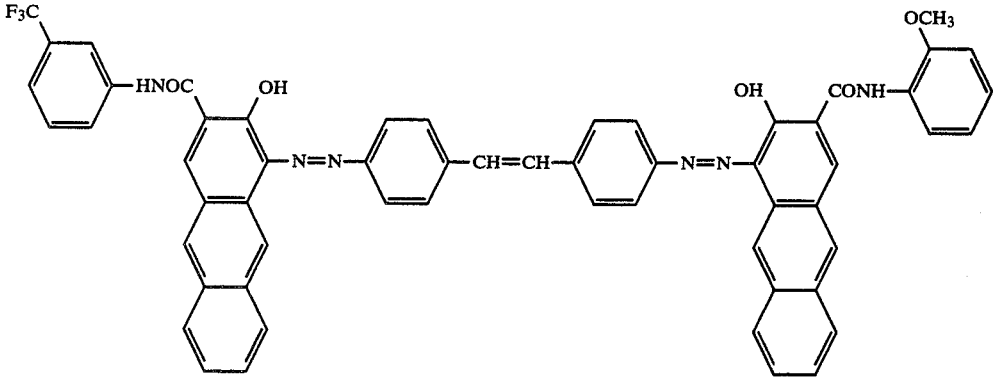
[I]-(18)
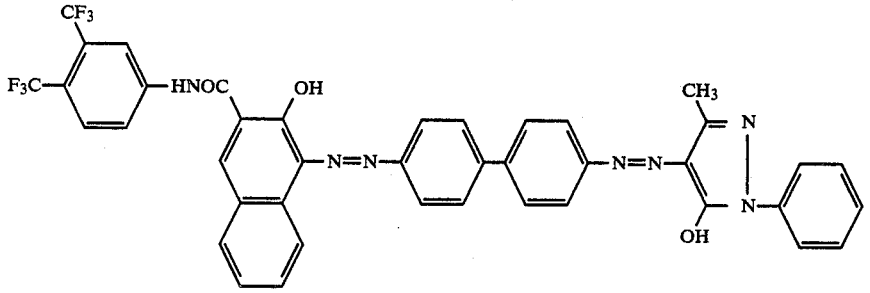
[I]-(19)
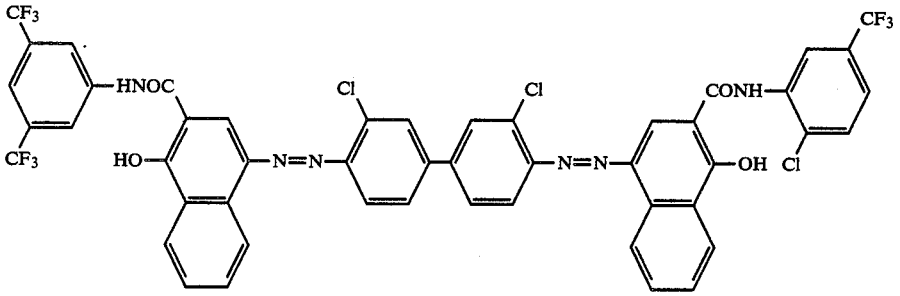

-continued
[I]-(20)
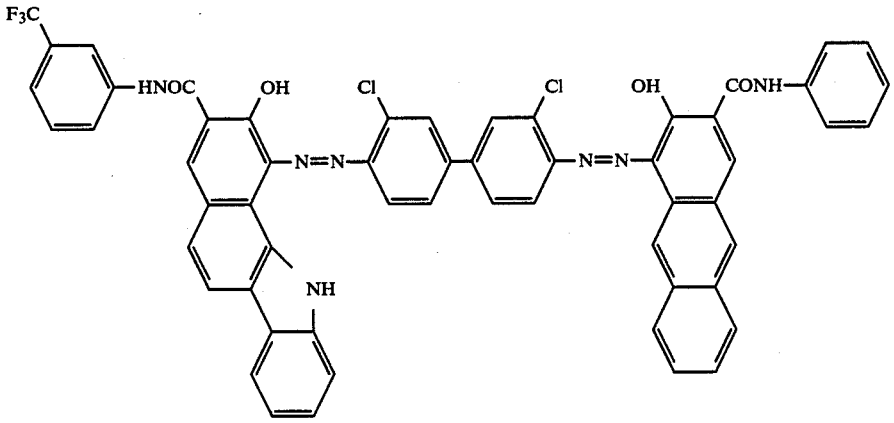
[I]-(21)
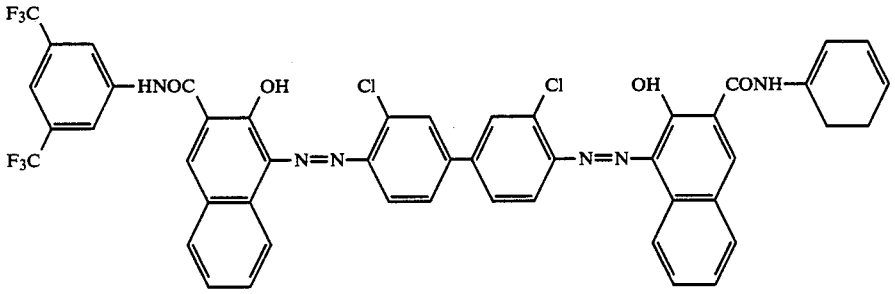
[I]-(22)
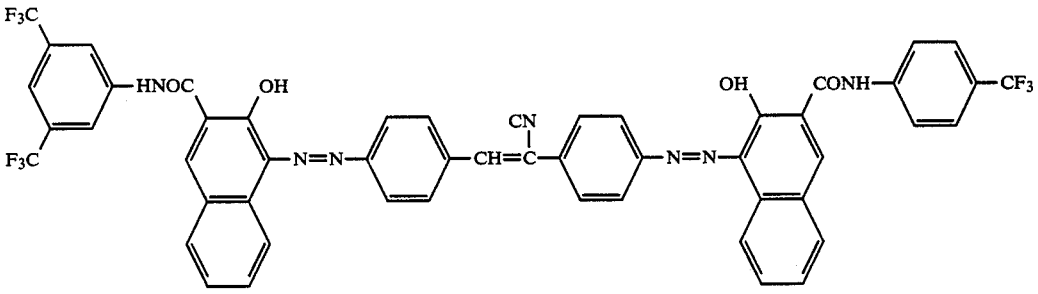
[I]-(23)
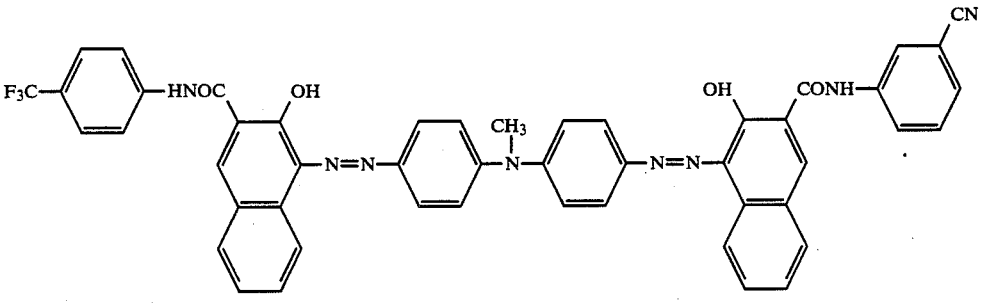
Compounds represented by the general formula [II] which is simplified as follows:
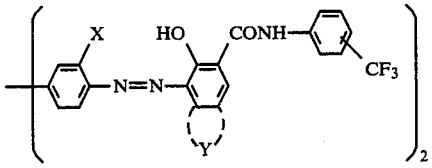
-continued
[II]-(1)
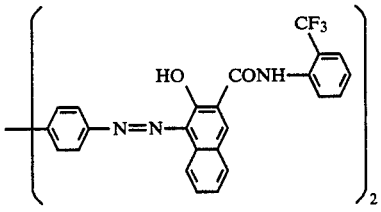

-continued
[II]-(2)
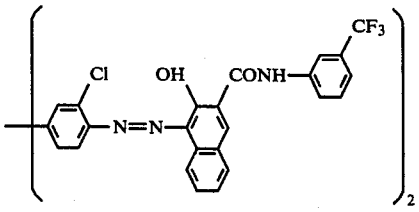
[II]-(3)
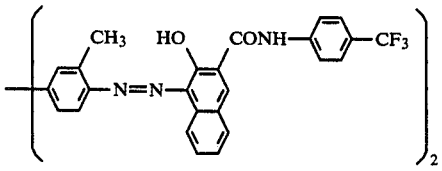
[II]-(4)
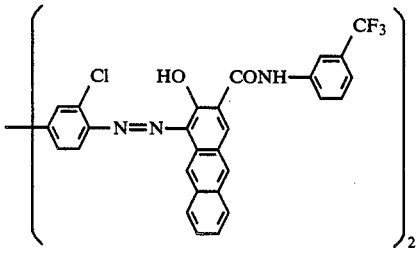
[II]-(5)
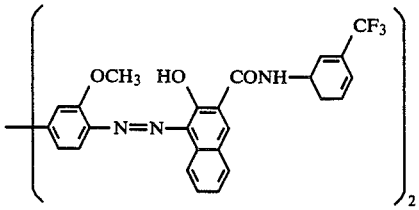
[II]-(6)
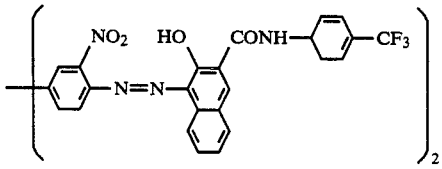
[II]-(7)
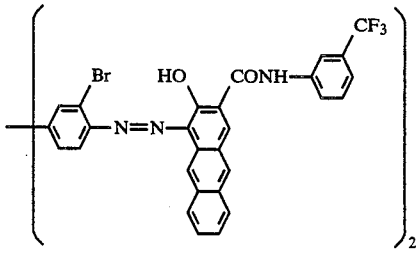
-continued
[II]-(8)
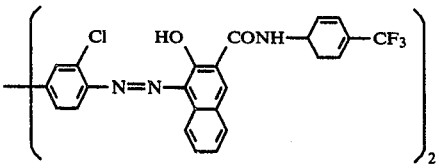
[II]-(9)
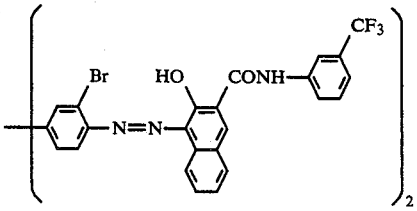
[II]-(10)
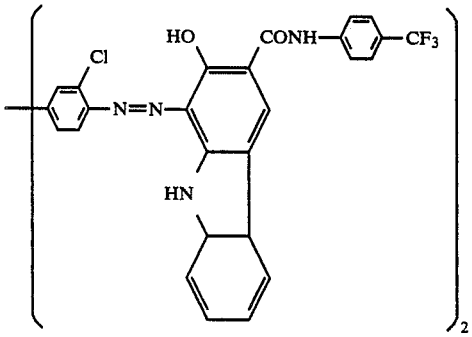
[II]-(11)
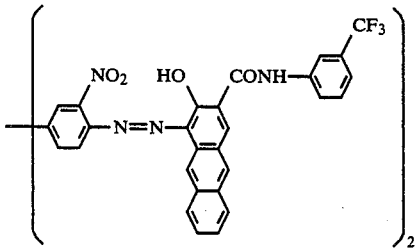
[II]-(12)
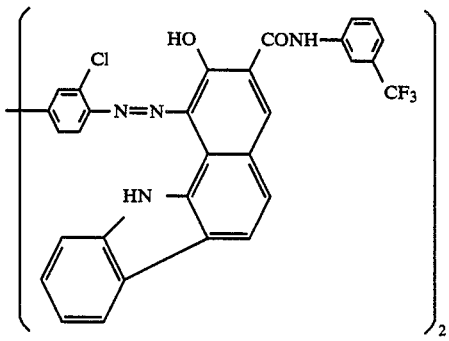

-continued
[II]-(13)
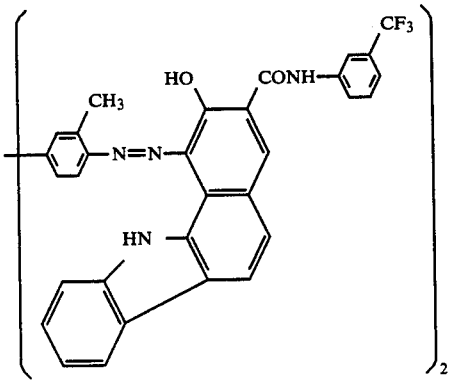
[II]-(14)
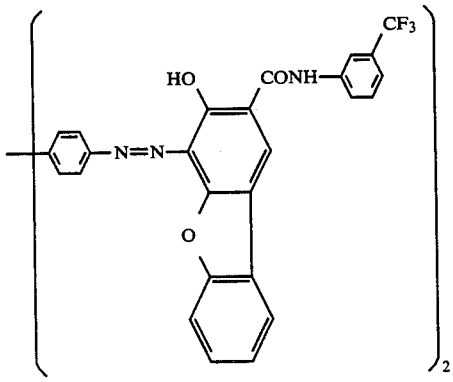
-continued
[II]-(15)
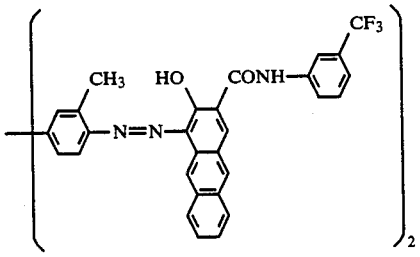
[II]-(16)
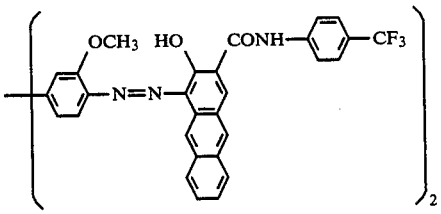
Compounds represented by the general formula [III]:
[III]-(1)
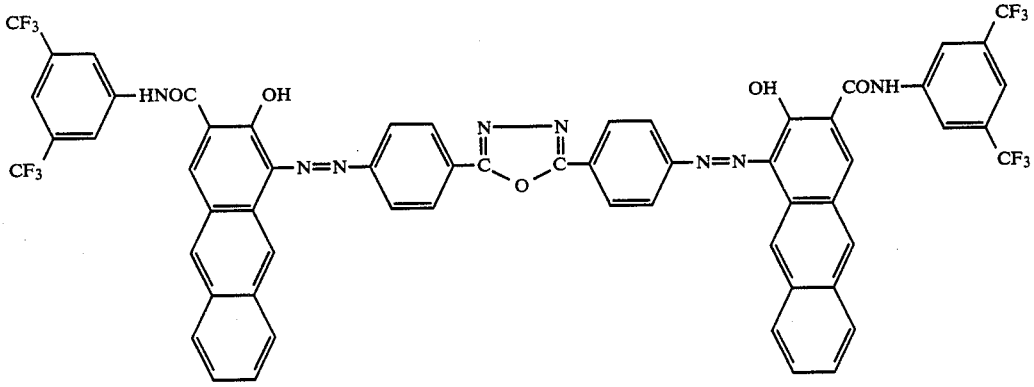
[III]-(2)
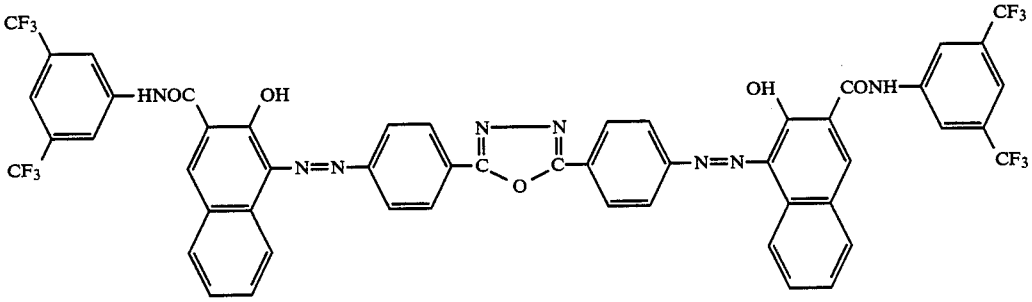

-continued
[III]-(3)
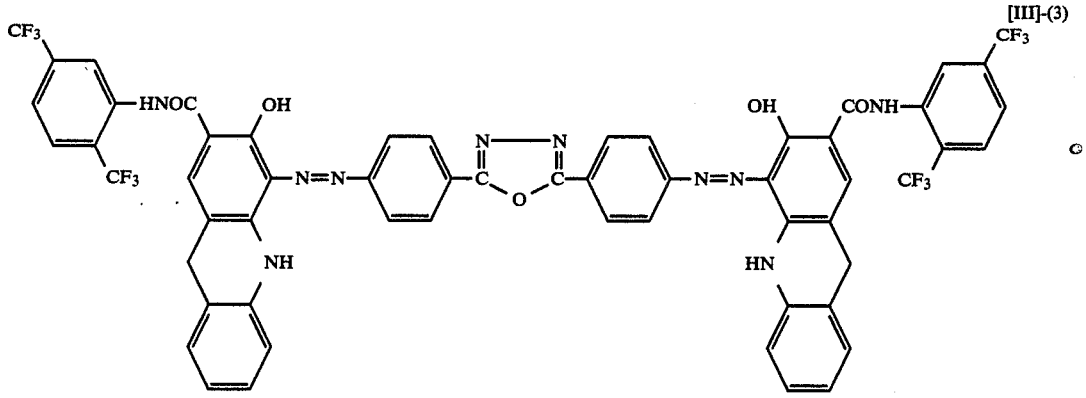
[III]-(4)
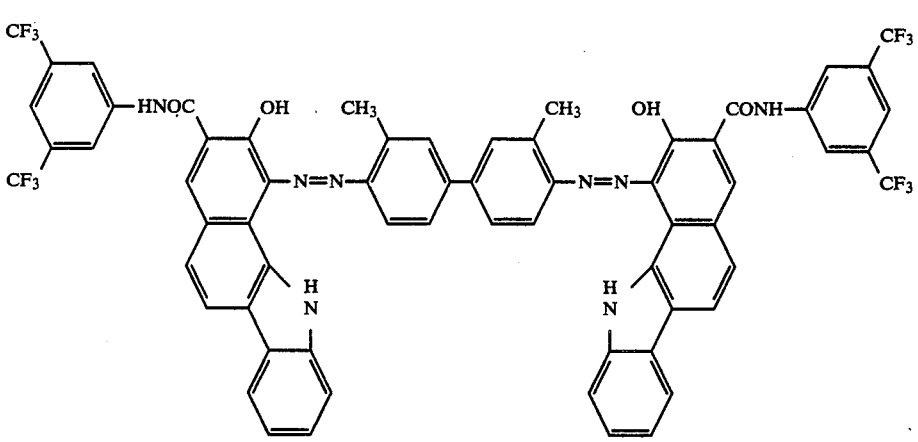
[III]-(5)
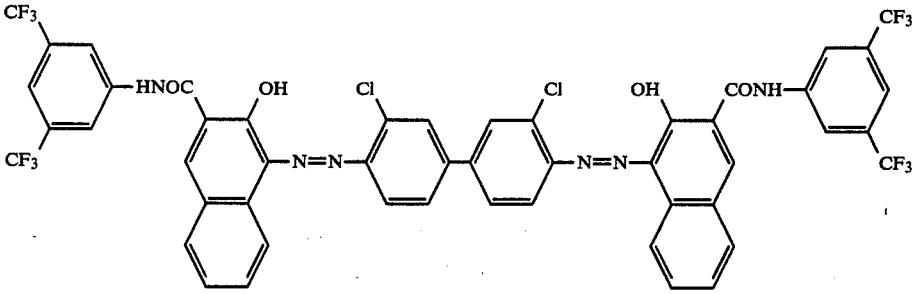
[III]-(6)
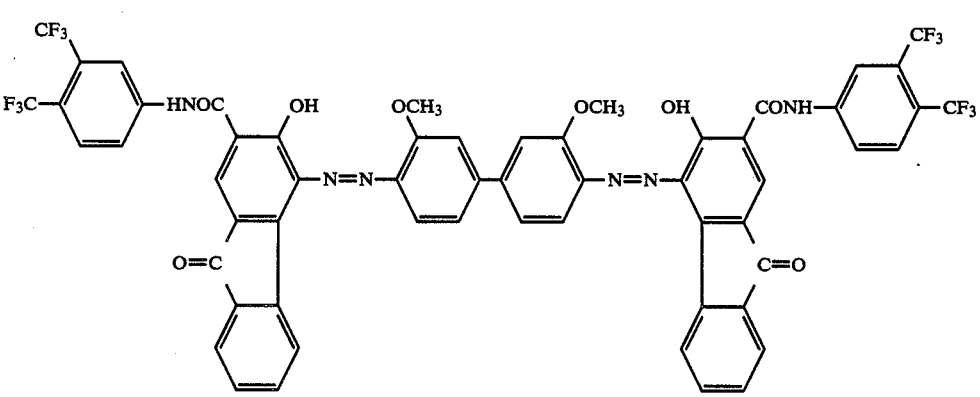

-continued
[III]-(7)
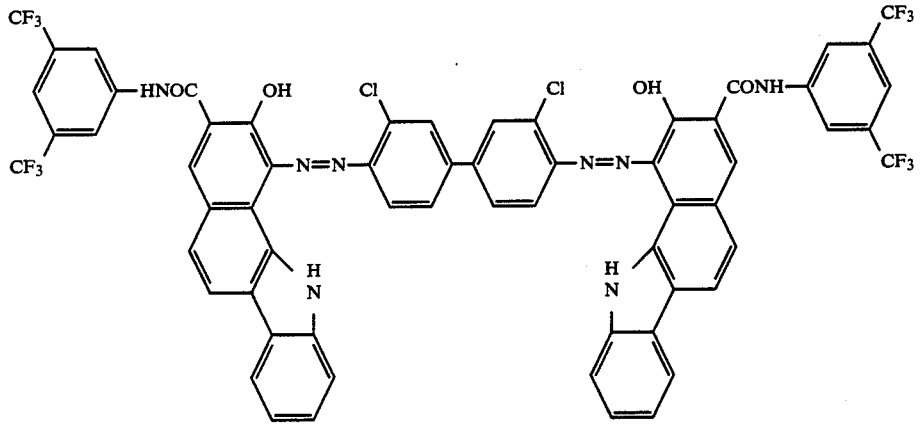
[III]-(8)
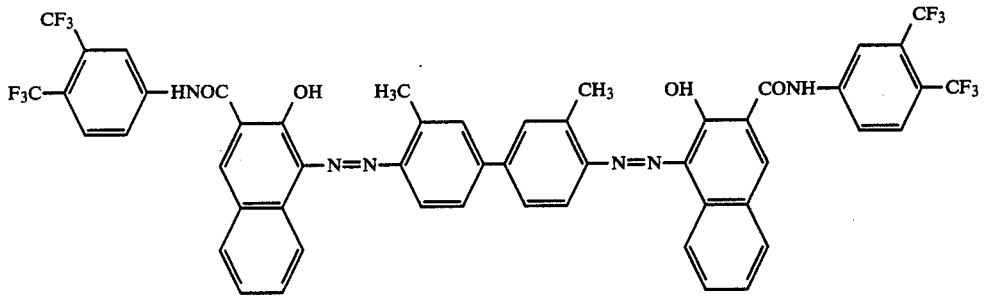
[III]-(9)
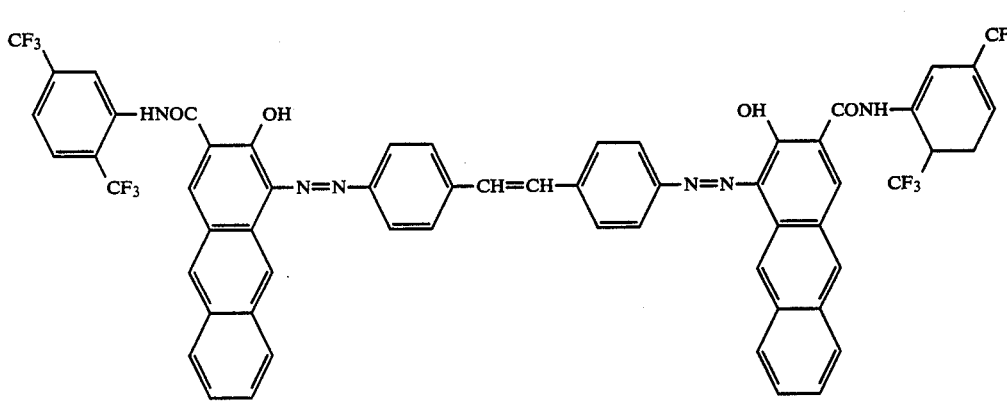
[III]-(10)
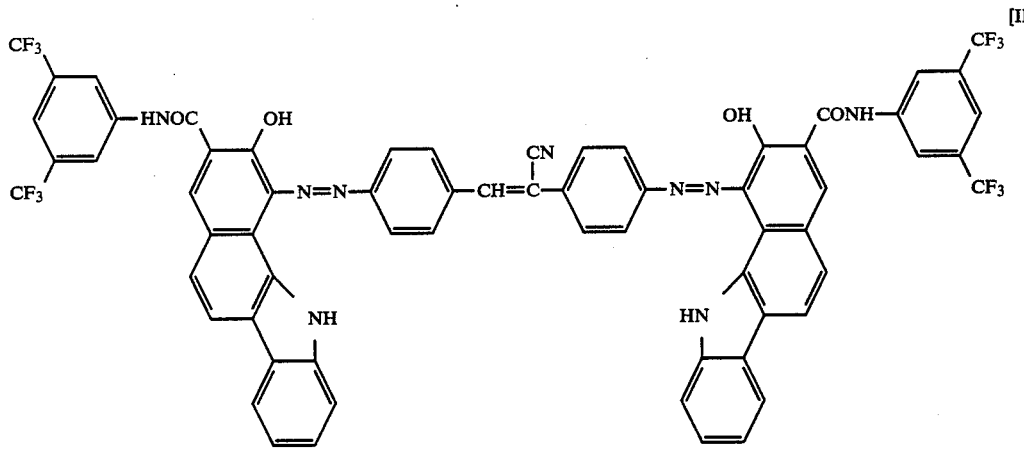

-continued

[III]-(11)

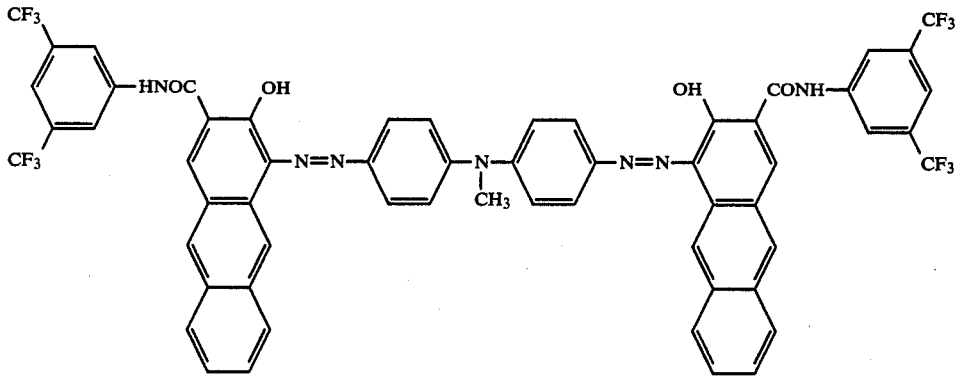

[III]-(12)

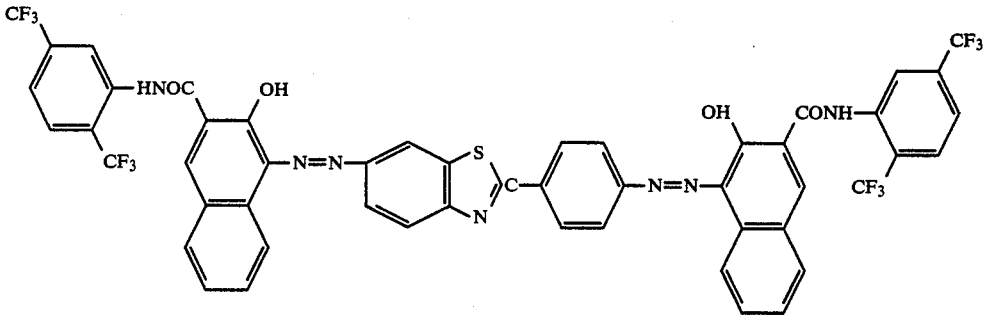

[III]-(13)

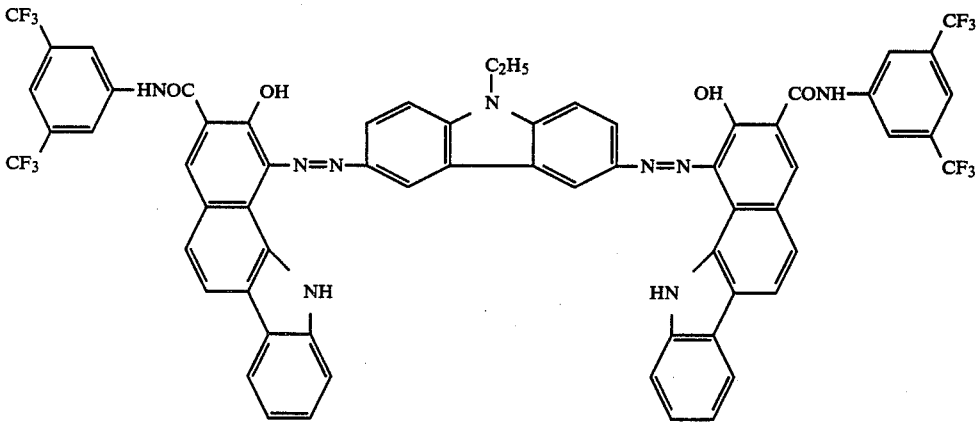

The compounds represented by the general formulas [I]-[III] are synthesized by conventional methods.

Synthesis of compounds represented by the general formula [I]:

An N-monoacyl derivative which is a diamino compound represented by the general formula $H_2N—A—NH_2$ (wherein A has the same meaning as in general formula I]) is diazotized by conventional method. The resultant diazonium salt is coupled with a compound which is the first coupling component and represented by the following general formula

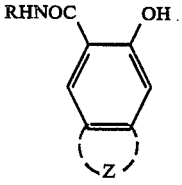

(wherein R and Z have the same meanings as in the general formula [I]) to obtain a monoazo compound representad by the general formula [I'], which is then hydrolyzed to obtain an aminoazo compound represented by the general formula [I''].

[I']

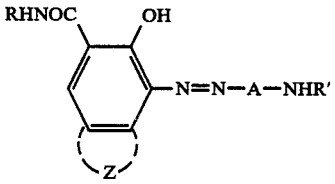

(wherein R, Z and A have the same meanings as in the general formula [I] and R' is an acyl group).

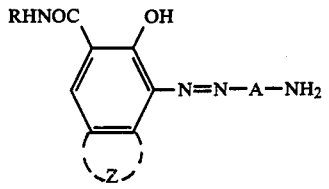

[I'']

wherein R, Z and A have the same meanings as in the general formula [I]). Then, the aminoazo compound represented by the general formula [I''] is diazotized by conventional method. The resultant diazonium salt is coupled with said coupling component (a), (b), (c), (d), (e) or (f) (this second coupling component is different from the first coupling component) to obtain a bis-azo compound represented by the general formula [I].

The compounds represented by the general formula [II] can be readily synthesized by conventional method. That is, they are produced by the coupling reaction of a benzidine derivative substituted with X having the same meanings as in the general formula [II] as a diazo component and a phenylcarbamoyl condensation cyclized phenol derivative substituted with $CF_3$ group as a coupling component.

The azo compounds represented by the general formula [III] can be readily synthesized by tetrazotizing a diamine represented by the general formula $H_2N—A—NH_2$ (wherein A has the same meaning as in the general formula [III]) by conventional method and then coupling the product with a corresponding coupler in the presence of an alkali or by once isolating a tetrazonium salt of said diamine in the form of borofluoride salt or zinc chloride double salt and then coupling the salt with the coupler in a suitable solvent such as N,N-dimethylformamide, dimethylsulfoxide or the like in the presence of an alkali.

Typical synthesis examples of these azo pigments of the general formulas [I]–[III] are shown below.

Synthesis Example 1 (Synthesis of [I]-(21) exemplified hereinbefore)

5.9 g (0.02 mol) of 4-acetylamino-3,3'-dichlorobiphenylamine was dispersed in 100 ml of water and 6 g of 35% hydrochloric acid. To the resultant dispersion kept at 0°–5° C. with well sterring was added dropwise 12 g of 10% aqueous sodium nitrite solution over 10 minutes to obtain a diazo solution. 8.8 g (0.022 mol) of N-(3,5-α,α,α,α',α',α'-hexafluoroxylyl)-3-hydroxy-2-naphthoic acid amide was dissolved in 3.8 g (0.026 mol) of triethanolamine and 200 ml of dimethylsulfoxide. To this solution cooled and kept at 0°–5° C. was added dropwise said diazo solution over one hour. After completion of the addition, the solution was stirred for further one hour and the resultant monoazo compound was subjected to salting-out and thoroughly washed with water. Thereafter, this was deflocculation-dispersed in water to make the total amount 50 parts, followed by adding thereto 50 parts of 35% hydrochloric acid and heating and stirring for 6 hours under reflux. Thus produced hydrochloride slurry of aminoazo compound was cooled with ice and precipitate was filtered out, washed with a small amount of cold dilute hydrochloric acid and then deflocculationdispersed in water to obtain totally 100 ml of a dispersion. To this liquid was added 4 g of 35% hydrochloric acid. To this liquid cooled and kept at 0°–5° C. was added dropwise 12 parts of 10% aqueous sodium nitrite solution over 30 minutes followed by stirring for 30 minutes to obtain a diazo solution. This diazo solution was added dropwise over 30 minutes to a solution obtained by dissolving with heat 5.3 g (0.02 mol) of Naphthol AS in 160 ml of 2% alcoholic potassium hydroxide solution and cooled to 0°–5° C., followed by stirring for further one hour. The precipitate produced was filtered out and thoroughly washed with water to obtain 12.8 g of a crude compound [I]-(21). This compound was successively washed with DMF, THF and acetone and vacuum dried to obtain a black powder having somewhat metallic luster. Other compounds of the general formula [I] can also be produced in accordance with the above method.

Synthesis Example 2 (Synthesis of compound[II]-(2)) 2 mmols of 3,3'-dichlorobenzidine was added to 8 ml of 4N-HCl. Thereto was added dropwise 1 ml of an aqueous solution containing 4 mmols of $NaNO_2$ under cooling and stirring. After stirring for 30 minutes 1 ml of an aqueous solution containing 10 mmols of $NaBF_y$ was added thereto and the precipitate produced was filtered out. This precipitate was added to a solution of 20 ml of dimethylformamide containing 4 mmols of 3-(m-trifluoromathylphenylcarbamoyl)-2-naphthol (mp 242° C.) under cooling and stirring followed by adding 3 ml of an aqueous solution containing 10 mmols of sodium acetate and stirring for 3 hours. The pigment produced was filtered out, washed with water and then washed with acetone by Soxhlet's extractor. The product had a melting point of 360° C. or more.

Synthesis Example 3 (Synthesis of compound [III]-(5)):

3.8 g (0.015 mol) of 3,3'-dichlorobenzidine was added to and dispersed in a mixture of 3.5 ml of concentrated hydrochloric acid, 20 ml of water and 20 ml of dimethylsulfoxide. To this dispersion was added dropwise under ice cooling a solution prepared by dissolving 2.76 g (0.04 mol) of sodium nitrite in water and reaction was carried out for about one hour under cooling, followed by addition of activated charcoal and filteration to obtain an aqueous tetrazonium solution.

12 g (0.03 mol) of 2-hydroxy-3-α,α,α, α',α',α'-hexafluoro-3',5'-xylyl)naphthoic acid amide (m.p. 235°–236.5° C.) as a coupling component and 15 g (0.1 mol) of triethanolamine as an organic amine were dissolved in 1000 ml of DMF. To this coupler solution cooled to 0°–5° C. was added dropwise said diazonium salt solution and the resultant bluish purple pasty liquid was kept at 0°–10° C. and stirred for further 3 hours. The precipitate produced was filtered out, fully washed with acetone and then water and finally with acetone and dried to obtain 8.9 g of blackish blue powder having a melting point of 350° C. or higher.

The above synthesis examples are merely some examples and other azo compounds of this invention can easily be obtained in accordance with these synthesis examples.

The electrophotographic sensitive materials of this invention have a light-sensitive layer containing at least one of azo compounds represented by the general formulas [I]–[III]. Light-sensitive layers of various types are known and the light-sensitive layer of the electrophotographic sensitive materials of this invention may be any of these known layers. Examples are of the following types.

(1) Light-sensitive layer comprising azo compound.

(2) Light-sensitive layer comprising a binder in which the azo compound is dispersed.

(3) Light-sensitive layer comprising a known charge transport substance in which the azo compound is dispersed.

(4) Light-sensitive layer comprising a laminate of either one of said layers (1)–(3) as a charge generation layer and a charge transport layer containing a known charge transport substance.

The azo compounds represented by said general formulas generate a charge carrier in a very high efficiency upon absorption of light. The generated carriers can be transported through azo compound as a medium, but preferably they are transported through a known charge transport substance as a medium. For this reason, the sensitive layers of types (3) and (4) are especially preferred.

Charge transport substances can generally be classified to two kinds, the electron transport substance and the hole transport substance. Both can be used for the light-sensitive layer of the sensitive materials of this invention. Furthermore, mixtures of the substances having same functions or those having different functions can also be used. The electron transport substances include electron attracting compounds having an electron attracting group such as nitro group, cyano group, ester group or the like. Examples of these compounds are nitrated fluorenones such as 2,4,7-trinitrofluorenone, 2,4,5,7-tetranitrofluorenone, etc., compounds such as tetracyanoquinodimethane, tetracyanoethylene, 2,4,5,7-tetranitroxanthone, 2,4,8-trinitrothioxanthone, etc. and polymers of these electron attracting compounds.

As the holes transport media, the following electron donative organic photoconductive compounds can be exemplified.

Hydrazones (1)

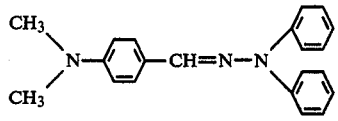

(2)

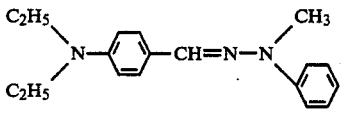

(3)

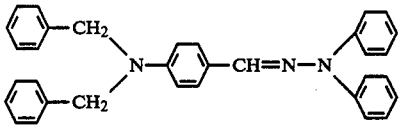

(4)

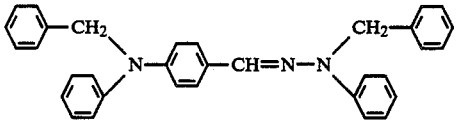

(5)

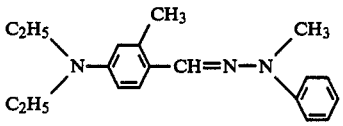

-continued (6)

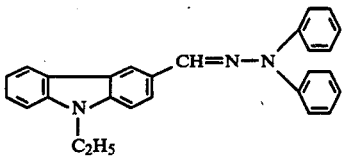

(7)

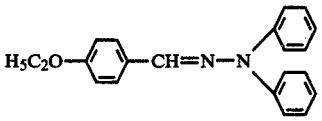

(8)

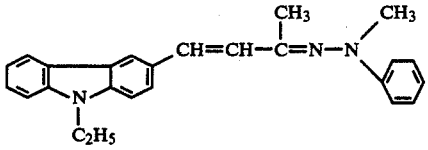

(9)

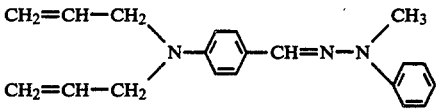

(10)

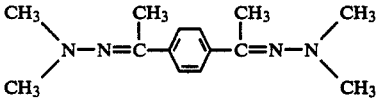

(11)

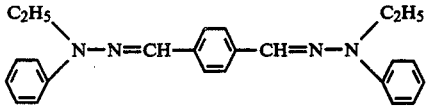

(12)

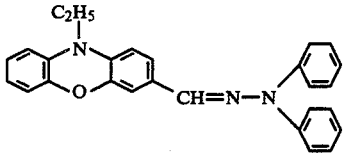

(13)

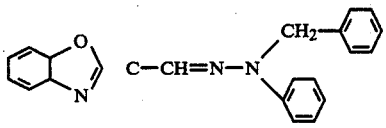

(14)

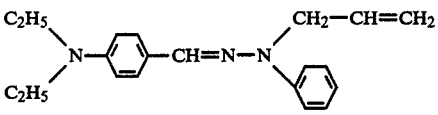

(15)

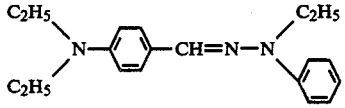

(16)

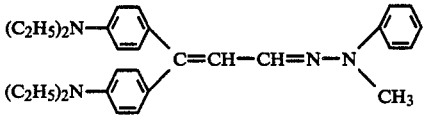

-continued
(17)
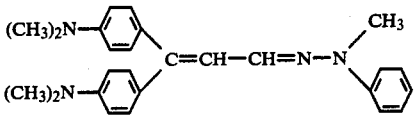
(18)
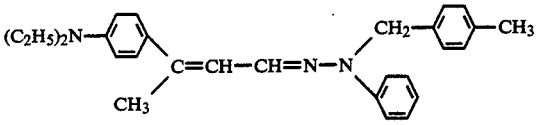
(19)
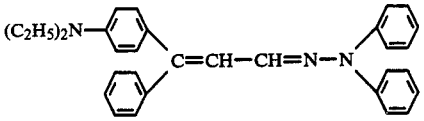
(20)
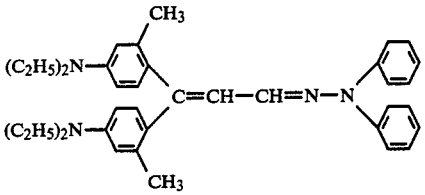
(21)
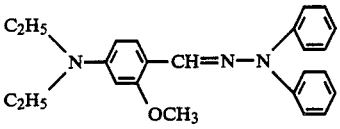
Pyrazolines
(1)
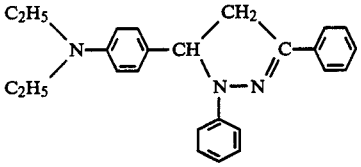
(2)
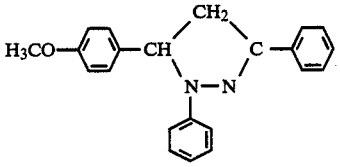
(3)
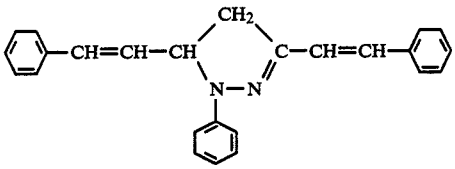
(4)
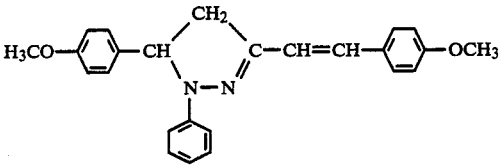
-continued
(5)
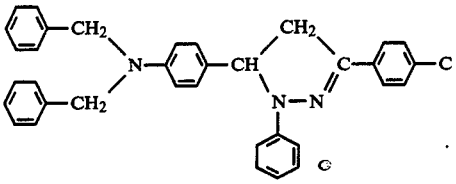
(6)
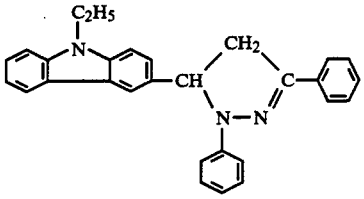
(7)
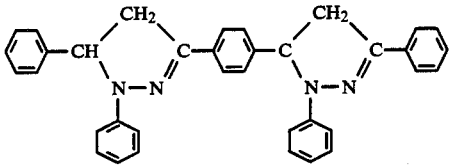
(8)
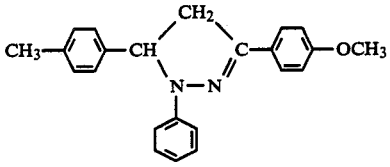
(9)
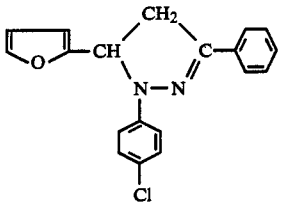
(10)
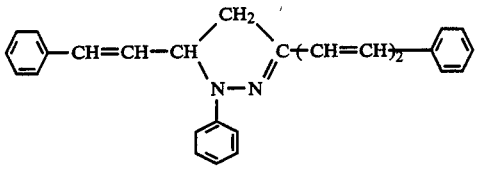
(11)
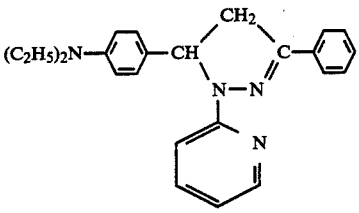
Diarylalkanes
(1)
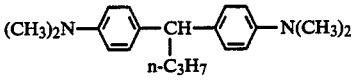
(2)
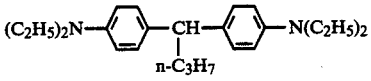

-continued
(3)
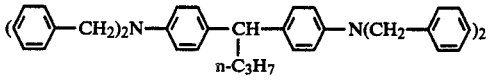
(4)
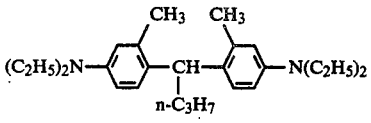
(5)
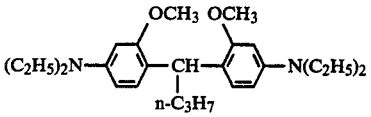
(6)
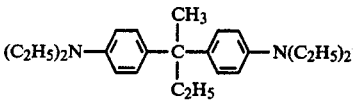
(7)
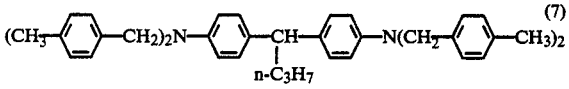
(8)
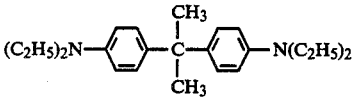
(9)
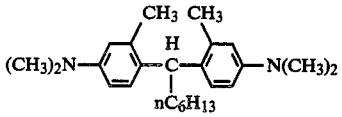
(10)
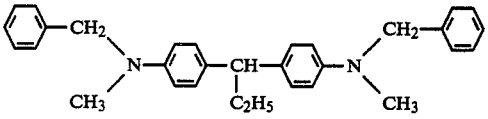
(11)
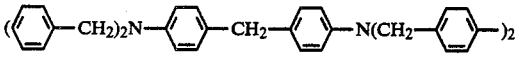
(12)
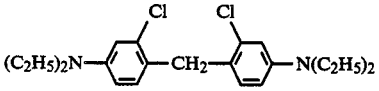
Alkylenediamines
(1)
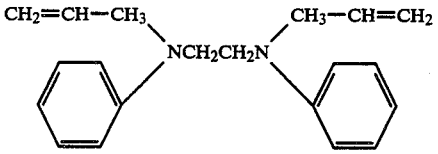
(2)
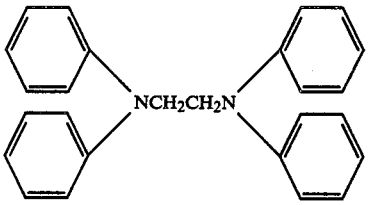
-continued
(3)
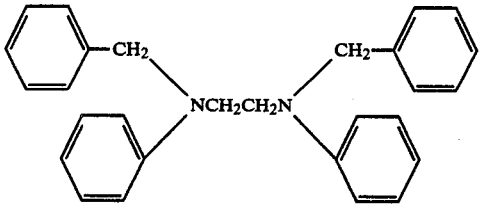
(4)
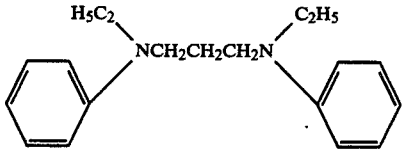
(5)
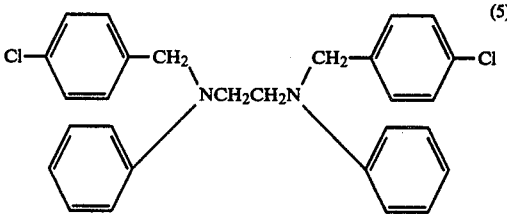
Dibenzylanilines
(1)
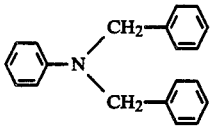
(2)
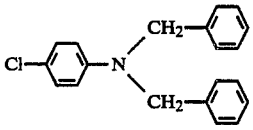
(3)
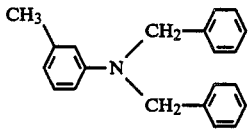
(4)
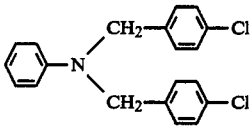
(5)
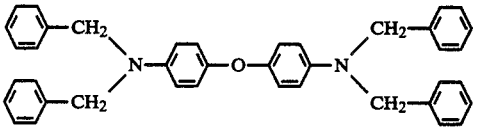
(6)
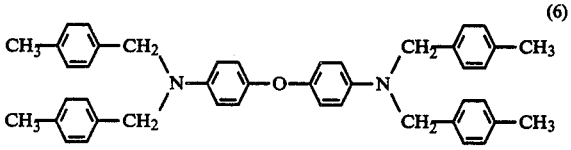

-continued
(7)
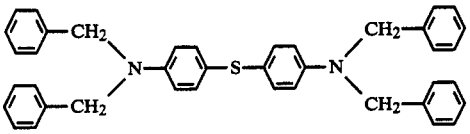
(8)
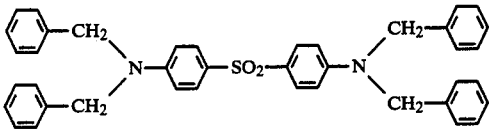
(9)
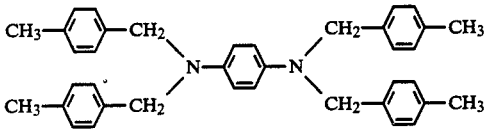
(10)
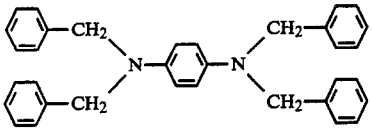
Triphenylamines
(1)
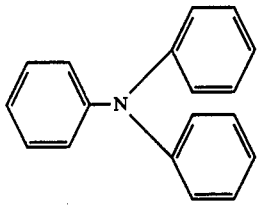
(2)
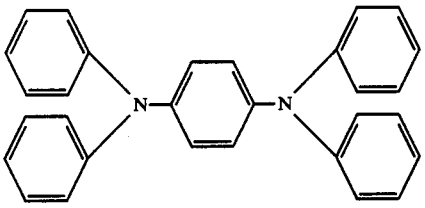
(3)
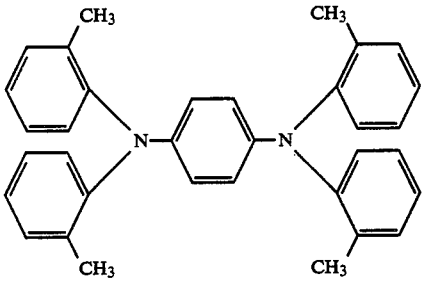
Diphenylbenzylamines
(1)
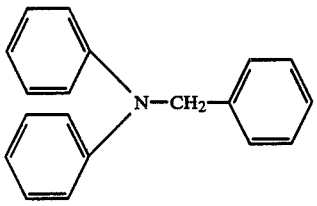
-continued
(2)
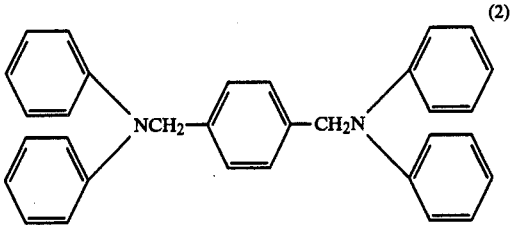
(3)
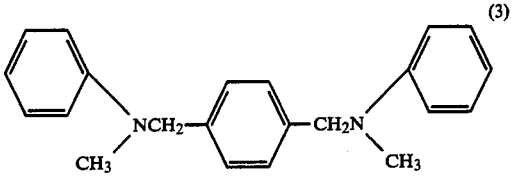
Triarylalkanes
(1)
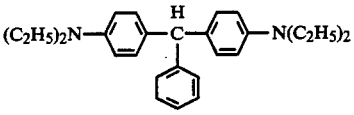
(2)
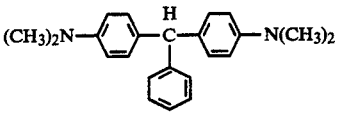
(3)
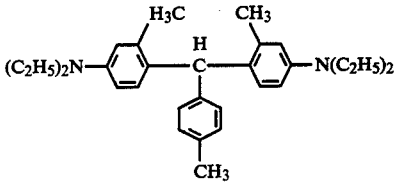
(4)
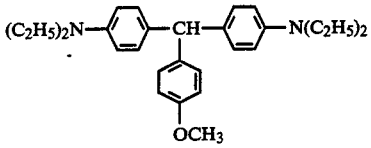
(5)
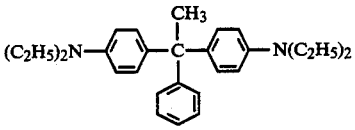
(6)
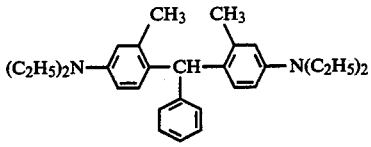
(7)
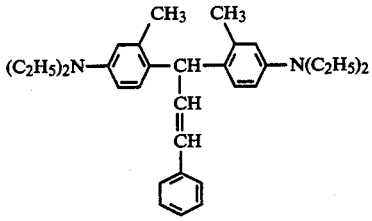

-continued
(8)
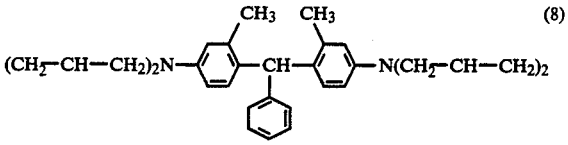
(9)
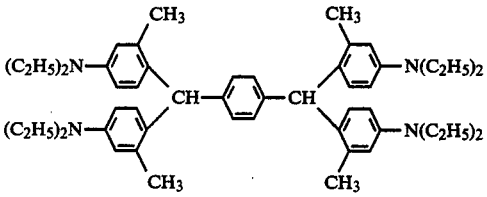
Oxadiazoles
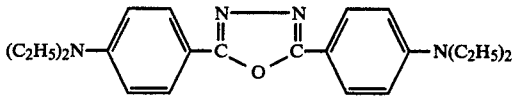
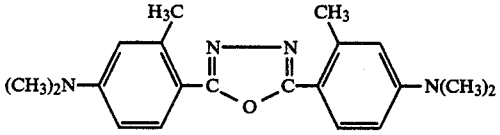
(3)
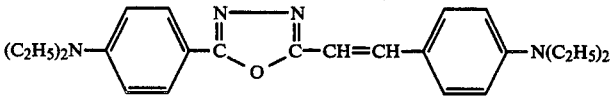
(4)
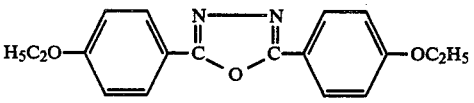
(5)
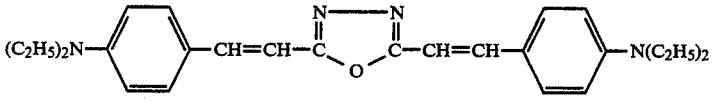
(6)
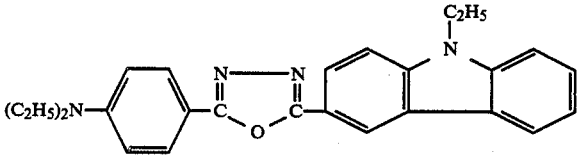
(7)
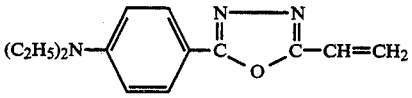
Anthracenes
(1)
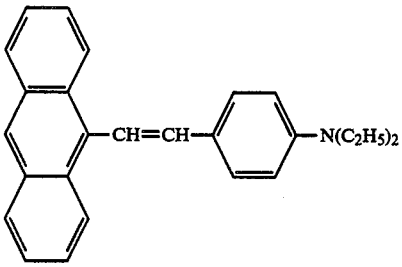
-continued
(2)
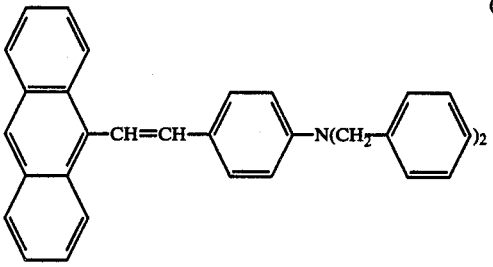
(3)
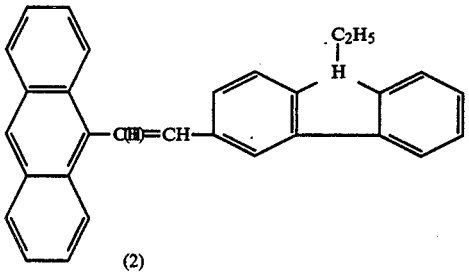
(2)
(3)
(4)
(5)
(6)
(7)
Oxazoles and thiazoles (1)

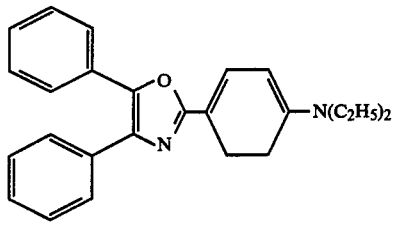

(2)

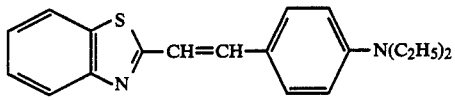

(3)

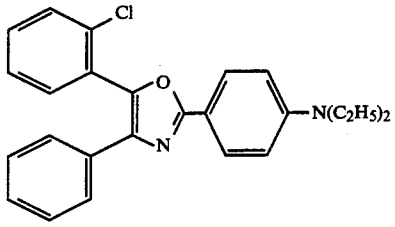

(4)

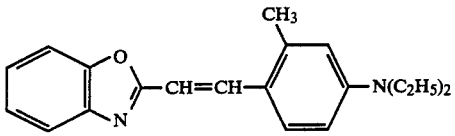

(5)

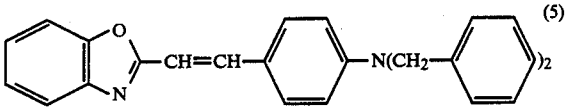

(6)

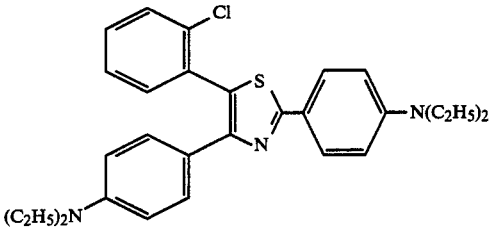

Furthermore, there may be used high molecular compounds such as poly-N-vinylcarbazole, halogenated poly-N-vinylcarbazole, polyvinylpyrene, polyvinylanthracene, polyvinylacridine, polyglycidylcarbazole, polyvinylacenaphthylene, ethylcarbazoleformaldehyde resin, etc.

Carrier transport substances are not limited to those mentioned here and they may be used alone or in admixture of two or more.

The electrophotographic sensitive materials of this invention can be made in accordance with the conventional method.

For example, electrophotographic sensitive materials having the light-sensitive layer of type (1) mentioned above can be made by coating on an electrically conductive support a coating solution obtained by dissolving or dispersing an azo compound represented by the general formulas [I]-[III] in an appropriate medium and drying the coating to form a light-sensitive layer of generally several $\mu m \sim$ several tens $\mu m$ thick.

As the media used for preparation of the coating solution, mention may be made of basic solvents which dissolve bis-azo compounds such as butylamine, ethylenediamine, etc. or media which disperse azo compounds such as ethers, e.g., tetrahydrofuran, 1,4-dioxane, etc.: ketones, e.g., methyl ethyl ketone, cyclohexanone, etc.: aromatic hydrocarbons, e.g., toluene, xylene, etc.: non-protonic polar solvents, e.g., N,N-dimethylformamide, acetonitrile, N-methylpyrrolidone, dimethylsulfoxide, etc.: alcohols, e.g., methanol, ethanol, isopropanol, etc.: esters, e.g., ethyl acetate, methyl acetate, methyl cellosolve acetate, etc.: chlorinated hydrocarbons, e.g., dichloroethane, chloroform, etc.

When a medium which disperses azo compound is used, the azo compound must be made to fine particles of less than 5 $\mu m$, preferably less than 3 $\mu m$, most preferably less than 1 $\mu m$ in particle diameter.

As the conductive supports on which a light-sensitive layer is formed there may be used any of those which are employed for conventional electrophotographic sensitive materials.

Specifically, there may be used metallic drums or sheets of aluminum, copper, etc. or laminates of foils of these metals or metallized sheets thereof.

Furthermore, mention may be made of plastic films, plastic drums and papers which are coated with electrically conductive substances such as metallic powder, carbon black, copper iodide, high polymer electrolyte and the like together with suitable binders and are subjected to conduction treatment. In addition, there may be exemplified plastic sheets or drums rendered conductive by containing electrically conductive substances such as metallic powder, carbon black, carbon fiber and the like.

Electrophotographic sensitive materials having a light-sensitive layer of type (2) can be produced by dissolving a binder in the coating solution as used for forming the sensitive layer of type (1). In this case, the medium for the coating solution is preferably one which dissolve the binder.

As examples of the binders, mention may be made of polymers or copolymers of vinyl compounds such as styrene, vinyl acetate, acrylic esters, methacrylic esters and the like and various polymers such as phenoxy resin, polysulfone, arylate resin, polycarbonate, polyester, cellulose ester, cellulose ether, urethane resin, epoxy resin, acryl polyol resins, etc.

Amount of binders used is ordinarily 0.1-5 times the weight of the azo compounds.

It is preferred for forming the sensitive layers of these types to allow a azo compound in the form of fine particles, e.g., less than 3 $\mu m$, especially less than 1 $\mu m$ in diameter to be present in the binder.

Similarly, electrophotographic light-sensitive materials having a sensitive layer of the type (3) can be produced by dissolving a charge transport substance in the coating solution used for formation of the light-sensitive layer of the type (1). As the charge transport substance, any of those which are exemplified hereinbefore may be used.

Except for the charge transport substance which per se can be used as a binder such as polyvinylcarbazole, polyglycidylcarbazole, etc., others are preferably used with a binder.

As the binders, any of those which are exemplified hereinbefore may be used.

In this case, amount of the binder used is normally 5-1000 times the weight of the azo compound. Amount of the charge transport substance is normally 0.2-1.5 time, preferably 0.3-1.2 time the weight of the binder and that of the medium which per se can be used as a binder, is normally 5–10 times the weight of the azo compound.

Like the sensitive layer of the type (2), the sensitive layer of this type is also formed preferably in the presence of the azo compound in the form of fine particles in the charge transport substance and the binder.

Electrophotographic sensitive materials having a light-sensitive layer of the type (4) can be produced by forming a charge transport layer by coating a coating solution prepared by dissolving a charge transport substance in a suitable medium on the sensitive layer of the type (1), (2) or (3) and drying the coating. In this case, charge generation layer normally has a thickness of about 0.03–3μ. In this case the light-sensitive layers of the types (1), (2) and (3) play a role of a charge generation layer. The charge transport layer is not necessarily provided over the charge generation layer, but may be provided between the charge generation layer and the electrically conductive support. However, from the point of endurance it is preferably provided over the charge generation layer.

The charge transport layer may be formed in the same manner as the formation of the light-sensitive layer of the type (3). That is, there may be used the coating solution used for formation of the sensitive layer of the type (3) from which the azo compound has been omitted.

Generally, the charge transport layer has a thickness of 5–50 μm.

Of course, the sensitive layer of the electrophotographic sensitive materials of this invention may contain known sensitizers.

Suitable sensitizers include dyes and Lewis acids which form a charge-transfer complex with an organic photoconductive substance.

As examples of the Lewis acids, mention may be made of electron attracting compounds, e.g., quinones such as chloranil, 2,3-dichloro-1,4-naphthoquinone, 2-methylanthraquinone, 1-nitroanthraquinone, 1-chloro5-nitroanthraquinone, 2-chloroanthraquinone, phenanthrenequinone, etc., aldehydes such as 4-nitrobenzaldehyde, ketones such as 9-benzoylanthracene, indandione, 3,5-dinitrobenzophenone, 3,3',5,5'-tetranitrobenzophenone, etc., acid anhydrides such as phthalic anhydride, 4-chloronaphthalic anhydride, etc., cyano compounds such as tetracyanoethylene, terephthalmalonitrile, 4-nitrobenzalmalonitrile, etc., and 3-benzalphthalide, 3-(α-cyano-p-nitrobenzal)phthalide, etc.

As examples of the dyes, mention may be made of triphenylmethane dyes such as Methyl Violet, Brilliant Green, Crystal Violet, etc., thiazine dyes such as Methylene Blue, etc., quinone dyes such as quinizarin, etc., cyanin dyes, pyrylium salts, thiapyrylium salts, benzopyrylium salts, etc.

Furthermore, the light-sensitive layer may contain inorganic photoconductive fine particles such as selenium, selenium-arsenic alloy and organic photoconductive pigments such as copper phthalocyanine pigment, perylene pigment, etc. In addition, the sensitive layer may contain known plasticizers to improve film forming ability, flexibility and mechanical strength.

As the plasticizers mention may be made of phthalic esters, phosphoric esters, epoxy compounds, chlorinated paraffins, chlorinated fatty acid esters, aromatic compounds such as methyl naphthalene, etc.

Of course, if necessary there may be further provided an adhesive layer, an intermediate layer and a transparent insulating layer.

The sensitive materials of this invention which contain the azo compounds are high in sensitivity, excellent in color sensitivity, small in variations in sensitivity and chargeability even when repeatedly used, extremely excellent in endurance and small in photo-deterioration.

Furthermore, the sensitive materials of this invention can be widely used in the fields to which electrophotography is applied such as sensitive materials in printers which use laser, cathode ray tube (CRT) and light-emitting diode (LED) as light source in addition to electrophotographic copying machine.

The following nonlimiting examples further illustrate this invention.

EXAMPLE 1

On an electrically conductive support comprising an aluminum foil-laminated polyester film (ALPET 85 of Daido Kako Co., Ltd.; aluminum film thickness: 10μ) was formed an intermediate layer of 0.05μ thick comprising a vinyl chloride-vinyl acetate-maleic anhydride copolymer (ESLEX MF-10 of Sekisui Chemical Co., Ltd.). A dispersion of azo compound prepared by dispersing 2 g of compound [I]-(1) exemplified before and 2 g of a polyarylate resin (U-100 of Unitika, Ltd.) in 100 ml of 1,2-dichloroethane for about 1 hour by a paint conditioner was coated on said intermediate layer and dried to form a carrier generation layer having a thickness of 0.5μ. Thereon was further coated a solution prepared by dissolving 5 g of a carrier transport substance N,N-dibenzylaminobenzaldehyde-1,1-diphenylhydrazone and 7 g of a polyarylate resin in 50 ml of 1,2-dichloroethane and dried to form a carrier transport layer of 12μ thick. Thus obtained electrophotographic sensitive material of this invention was stored in the dark at 30° C. for one week and thereafter was mounted in an electrostatic paper testing apparatus (SP-428 manufactured by Kawaguchi Electric Mfg. Co., Ltd.) to conduct the following tests for electrophotographic characteristics.

That is, the light-sensitive layer was charged by corona discharge for 5 seconds by application of a potential −6 kV by a charging device and a voltage Vo (−V) at this time was measured and then the surface was exposed to light from a halogen lamp under the condition that the intensity of illumination at the surface was 30 lux and exposure $E_{\frac{1}{2}}$ (lux·sec) required for the one-half decay of the initial surface potential was obtained.

Furthermore, the surface potential after exposure of 50 lux·sec, namely, residual potential $E_{50}$ (−V) was obtained. The same measurements were repeated 500 times. Further exposure was carried out for 0.3 second with 300 lux using tungsten lamp as discharging light to bring the residual potential to completely zero level.

The results are shown in Table 1.

TABLE 1

| | The first measurement | The 500th measurement |
|---|---|---|
| $V_0$ (−V) | 880 | 870 |
| $E_{\frac{1}{2}}$ (lux · sec) | 2.1 | 2.0 |
| $E_{50}$ (−V) | 0 | 0 |

EXAMPLES 2-4

Three electrophotographic sensitive materials were produced in the same manner as in Example 1 except that compounds [I]-(4), [I]-(7) and [I]-(8) were used as carrier generation substances and these were subjected to the same tests as in Example 1. The results are shown in Table 2 together with the results obtained when the following azo compound was used for comparison.

[I]-(a)

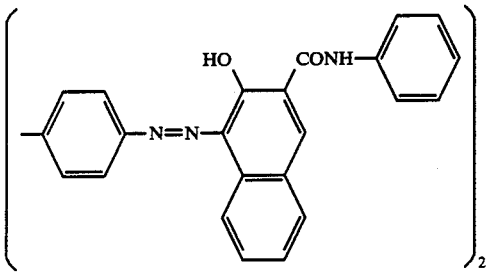

TABLE 2

| Examples | Azo compounds | The first measurement $V_0$ (−V) | The first measurement $E_{\frac{1}{2}}$ (lux · sec) | The first measurement $E_{50}$ (−V) | The 500th measurement $V_0$ (−V) | The 500th measurement $E_{\frac{1}{2}}$ (lux · sec) | The 500th measurement $E_{50}$ (−V) |
|---|---|---|---|---|---|---|---|
| 2 | [I]-(4) | 1150 | 2.0 | 0 | 1100 | 1.9 | 0 |
| 3 | [I]-(7) | 1100 | 1.8 | 0 | 980 | 1.6 | 0 |
| 4 | [I]-(8) | 1080 | 2.3 | 5 | 1030 | 2.2 | 5 |
| — | Comparative compound [I]-(a) | 1040 | 3.8 | 15 | 1030 | 3.7 | 10 |

EXAMPLE 5

On the outer surface of an aluminum drum of 60 mm in diameter was formed an intermediate layer of 0.04μ thick comprising a vinyl chloride-vinyl acetate (87:13) copolymer (VYHH produced by UCIC). On this intermediate layer was coated a dispersion obtained by dispersing 4 g of compound [I]-(21) in 400 ml of 1,2-dichloroethane for about 3 hours and was dried to form a carrier generation layer of 0.5μ thick. On thus formed carrier generation layer was coated a solution prepared by dissolving 10 g of a carrier transport substance N,N-diallylaminobenzaldehyde-1-phenyl-1-methylhydrazone represented by the structural formula:

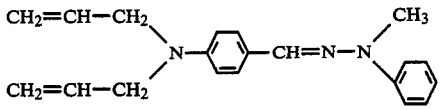

and 12 g of a polycarbonate resin (PANLITE L-1250 produced by Teijin Ltd.) in 100 ml of 1,2-dichloroethane and was dried to form a carrier transport layer of 15μ thick.

Thus obtained electrophotographic sensitive material was mounted in a commercially available cartridge type electrophotographic copying machine which was remodeled by Mitsubishi Paper Mills Ltd. and copying of images was carried out to obtain clear visible images high in contrast and faithful to originals. The copying was repeated 1,000 times to find that the last copied image was nearly the same as that of the first copied image.

Spectral sensitivities of this electrophotographic sensitive material at 660 nm and 670 nm were measured by a monochrometer. The energy required for one-half decay of initial potential was about 3.5 erg/cm$^2$ at both the wavelengths, indicative of high sensitivities. It was found that this sensitive material was sufficiently suitable for practical use even with light-emitting diode as a light source.

EXAMPLE 6

A mixture of a styrene-methyl methacrylatemethacrylic acid copolymer (styrene : methyl methacrylate=2:1 by weight; acid value=185), compound [I]-(22) and trifluorenone in a weight ratio of 1.5:1:0.3 was dissolved (resin component, trinitrofluorenone) and dispersed (azo compound) in dioxane. This liquid was coated on a grained aluminum plate and was dried to produce a single-layer type electrophotographic sensitive material of 6μ in film thickness.

This electrophotographic sensitive material of this invention was subjected to tests for electrophotographic characteristics by said electrostatic paper testing apparatus to obtain $V_0$=420 (+V) and $E_{\frac{1}{2}}$=4.0 (lux·sec) with an applied potential of +6 KV.

Furthermore, a visible image was formed on this electrophotographic material with a developer (tonor). The material was treated with an alkaline processing solution (e.g., 3% triethanolamine, 10% ammonium carbonate and 20% polyethylene glycol having an average molecular weight of 190–210) to easily dissolve away the area to which no toner adhered and then this was washed with water to easily obtain a printing plate. Offset printing was carried out with this printing plate to find that this plate can stand printing of about 100,000 copies.

Optimum exposure (light source:halogen lamp) to obtain a toner visible image was 30 lux·sec. The printing plate was produced by direct plate making method without block copy.

EXAMPLE 7

One part by weight of each of compounds [II]-(2), [II]-(3), [II]-(5) and [II]-(8) and 1 part by weight of a polyester resin (PYRON 200 produced by Toyobo Co., Ltd.) were added to dichloroethane solvent so that concentration became 5% by weight and they were mixed in a ball mill for 6 hours. Thus obtained dispersion was coated on an electrically conductive support comprising an aluminum foil-laminated polyester film by a doctor bar. This coating was dried to form a charge generation layer of 0.2μ thick.

On this charge generation layer was coated by a doctor bar a solution prepared by dissolving 1 part by weight of a charge transport substance p-diethylaminobenzaldehyde-diphenylhydrazone and 1 part by weight of a polycarbonate resin in dichloroethane solvent so that the concentration became 10% by weight and this was dried to form a charge transport layer of 13μ thick. Thus obtained function-separated type electrophotographic sensitive material was tested for electrophotographic characteristics by electrostatic recording paper testing apparatus SP-428 of Kawaguchi Electric Mfg. Co., Ltd. That is, initial potential ($V_0$) and half decay exposure ($E_{\frac{1}{2}}$) in case of a corona discharge of −6 KV were measured.

Similarly, an electrophotographic sensitive material was produced using the following compound for comparison.

[II]-(A)

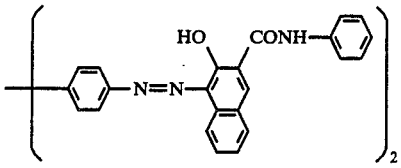

The results are shown in Table 3.

TABLE 3

| Compound | Initial potential ($V_0$) | Half decay exposure ($E_{\frac{1}{2}}$) |
|---|---|---|
| [II]-(2) | −810 (V) | 2.8 (lux · sec) |
| [II]-(3) | −830 | 3.5 |
| [II]-(5) | −820 | 4.0 |
| [II]-(8) | −850 | 2.5 |
| Comparative compound [II]-(A) | −790 | 6.0 |

EXAMPLE 8

In the same manner as in Example 7 an electrophotographic sensitive material was produced using the compounds [II]-(4), [II]-(11) and [II]-(15), respectively and an anodized aluminum plate as a support.

For comparison, an electrophotographic sensitive material was made in the same manner as above using the following compound.

[II]-(B)

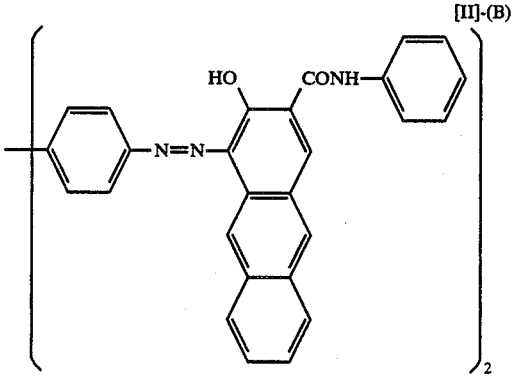

The results are shown in Table 4.

TABLE 4

| Compound | $V_0$ | $E_{\frac{1}{2}}$ |
|---|---|---|
| [II]-(4) | −830 | 3.0 (lux · sec) |
| [II]-(11) | −870 | 3.5 |
| [II]-(15) | −870 | 3.8 |
| Comparative compound [II]-(B) | −810 | 5.0 |

EXAMPLE 9

Using an aluminum cylinder of 60 mm in outer diameter as a support a drum type sensitive material was made by cylinder drum dipping coating method as follows.

Coating solutions for charge generation layer were prepared by adding 1 part by weight of each of compounds [II]-(2), [II]-(4), [II]-(8) and [II]-(12) and 1 part by weight of a polyarylate resin to dioxane solvent so that the concentration became 5% by weight and mixing them in a ball mill for 6 hours. Thus obtained coating solution was coated on said aluminum cylinder by cylinder dipping method and dried to form a coat of 0.2μ thick. Similarly, on this charge generation layer was coated a solution prepared by dissolving 1 part by weight of p-dibenzylaminobenzaldehyde-diphenylhydrazone as a charge transport substance and 1 part by weight of polycarbonate resin in dichloroethane so that the concentration became 10% by weight and was dried to form a charge transport layer of 18μ thick. Thus obtained electrophotographic sensitive drum was tested for characteristics by a cylinder sensitive material testing apparatus manufactured by Mitsubishi Paper Mills Ltd., namely, initial potential ($V_0$) and half decay exposure ($E_{\frac{1}{2}}$) for corona discharge of −6 KV were measured. Similarly, an electrophotographic sensitive material was produced using compound [II]-(A) used before and tested for comparison.

The results are shown in Table 5.

TABLE 5

| Compound | $V_0$ | $E_{\frac{1}{2}}$ |
|---|---|---|
| [II]-(2) | −1050 (V) | 1.5 (lux · sec) |
| [II]-(4) | −1070 | 1.8 |
| [II]-(8) | −1100 | 1.3 |
| [II]-(12) | −1090 | 1.9 |
| Comparative Compound [II]-(A) | −1010 | 3.5 |

EXAMPLE 10

Electrophotographic sensitive materials were produced in the same manner as in Example 7 except that 2,5-bis(4-diethylaminophenyl)-1,3,4-oxadiazole was used as the charge transport substance and were tested in the same manner. Comparison was made using the following compound.

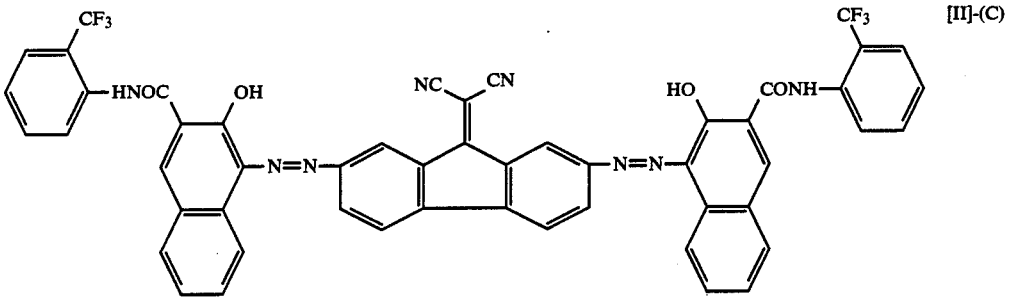

[II]-(C)

The results are shown in Table 6.

TABLE 6

| Compound | $V_0$ | $E_{\frac{1}{2}}$ |
|---|---|---|
| [II]-(2) | −805 (V) | 2.3 (lux · sec) |
| [II]-(3) | −815 | 2.5 |
| [II]-(8) | −800 | 2.1 |
| Comparative compound [II]-(C) | −780 | 4.2 |

EXAMPLE 11

On an electrically conductive support comprising an aluminum foil-laminated polyester film (Alpet 85 produced by Daido Kako Co., Ltd. and having an aluminum film thickness of 10μ) was formed an intermediate layer of 0.05μ thick comprising a vinyl chloride-vinyl acetate-maleic anhydride copolymer (ESLEX MF-10 produced by Sekisui Chemical Co., Ltd.). On this intermediate layer was coated an azo compound dispersion obtained by dispersing 2 g of compound [III]-(1) and 2 g of polyarylate resin (U-100 produced by Unitika Ltd.) in 100 ml of 1,2-dichloroethane for about 1 hour in a paint conditioner and was dried to form a carrier generation layer of 0.5μ thick. Furthermore, on this carrier generation layer was coated a solution prepared by dissolving 5 g of a carrier transport substance N,N-dibenzylaminobenzaldehyde-1,1-diphenylhydrazone and 7 g of polyarylate resin in 50 ml of 1,2-dichloroethane and was dried to form a carrier transport layer of 12μ thick. Thus produced electrophotographic sensitive material of this invention was stored in the dark at room temperature of 30° C. for one week and thereafter was tested for electrophotographic characteristics in the same manner as in Example 1.

The results are shown in Table 7.

TABLE 7

| | The first measurement | The 500th measurement |
|---|---|---|
| $V_0$ (−V) | 1050 | 1030 |
| $E_{\frac{1}{2}}$ (lux · sec) | 2.0 | 1.9 |
| $E_{50}$ (−V) | 0 | 0 |

EXAMPLES 12–14

Three electrophotographic sensitive materials were produced in the same manner as in Example 11 except that compounds [III]-(2), [III]-(5) and [III]-(9) were used as the carrier generation substance and were tested in the same manner.

For comparison, a sensitive material was similarly produced using the following azo compound and similarly tested.

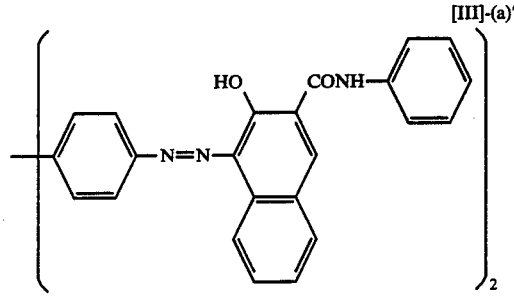

[III]-(a)'

The results are shown in Table 8.

TABLE 8

| Examples | Azo compound | The first measurement $V_0$ (−V) | The first measurement $E_{\frac{1}{2}}$ (lux · sec) | The first measurement E50 (−V) | The 500th measurement $V_0$ (−V) | The 500th measurement $E_{\frac{1}{2}}$ (lux · sec) | The 500th measurement E50 (−V) |
|---|---|---|---|---|---|---|---|
| 12 | Compound [III]-(2) | 980 | 1.9 | 0 | 970 | 1.8 | 0 |
| 13 | Compound [III]-(5) | 1020 | 1.7 | 0 | 1000 | 1.6 | 0 |
| 14 | Compound [III]-(9) | 1050 | 2.4 | 5 | 1040 | 2.3 | 0 |
| — | Comparative compound [III]-(a)' | 1040 | 3.8 | 15 | 1030 | 3.7 | 10 |

EXAMPLE 15

On the outer surface of an aluminum drum of 60 mm in diameter was formed an intermediate layer of 0.04μ thick comprising a vinyl chloride-vinyl acetate (87:13) copolymer (VYHH produced by UCIC). On this intermediate layer was coated a dispersion obtained by dispersing 4 g of compound [III]-(11) in 400 ml of 1,2-dichloroethane for about 3 hours by a paint conditioner and dried to form a carrier generation layer of 0.5μ thick. On this carrier generation layer was coated a solution prepared by dissolving 10 g of a carrier transport substance N,N-diallylaminobenzaldehyde-1-phenyl-1-methylhydrazone represented by the structural formula:

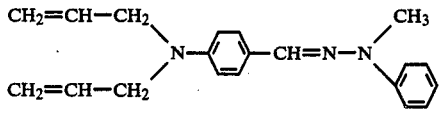

and 12 g of polycarbonate resin (PANLITE L-1250 produced by Teijin Ltd.) in 100 ml of 1,2-dichloroethane and was dried to form a carrier transport layer of 15μ thick.

Thus obtained electrophotographic sensitive material was mounted in a commercially available cartridge type electrophotographic copying machine remodeled by Mitsubishi Paper Mills Ltd. and copying was carried out to obtain clear visible images high in contrast and faithful to originals.

Copying was carried out 1000 times to find that the last copied image was the same as the first copied image.

Spectral sensitivities at 670 nm and 680 nm were measured by a monochrometer. The energy required for the one-half decay of initial potential was about 3.5 erg/cm$^2$ at both the wavelengths which indicated that this electrophotographic sensitive material was very high in sensitivity and can fully stand practical use even when a light-emitting diode was used as a light source.

EXAMPLE 16

A mixture of a styrene-methyl methacrylatemethacrylic acid copolymer (styrene:methyl methacrylate=2:1 in weight ratio and acid value=185), compound [III]-(13) and trinitrofluorenone in a weight ratio of 1.5:1:0.3 was dissolved (resin component, trinitrofluorenone) and dispersed (azo compound) in dioxane. This liquid was coated on a grained Al plate and was dried to produce a single-layer sensitive material having a coating thickness of 6μ.

Thus obtained sensitive material of this invention was tested for electrophotographic characteristics by the electrostatic recording paper testing apparatus used hereinbefore to obtain $V_0$=420 (+V) and $E_{\frac{1}{2}}$=4.0 (lux·sec) with applied voltage of +6 KV. Visible images were produced on this sensitive material with a developer (toner) and then the surface was treated with an alkaline processing solution (e.g., 3% triethanolamine, 10% ammonium carbonate, and 20% polyethylene glycol having an average molecular weight of 190–210). The areas of the coating to which no toner adhered readily dissolved away. Upon washing with water containing sodium silicate there was readily obtained a printing plate. This printing plate was found to endure printing of about 100,000 copies on an off-set press.

In the above experiment, an optimum exposure (a halogen lamp as light source) was 30 lux·sec. The printing plate was made by the direct plate making method without a block copy.

What is claimed is:

1. An electrophotographic sensitive material which comprises an electrically conductive support and a light-sensitive layer which contains at least one of the azo compound selected from the group consisting of the following general formulas [I]–[III]:

General Formula [I]:

$$Cp_1\text{-}N{=}N\text{-}A\text{-}N{=}N\text{-}Cp_2$$

wherein A represents a divalent residue which bonds through C atoms to N atoms which constitute azo and $Cp_1$ is a group represented by the formula:

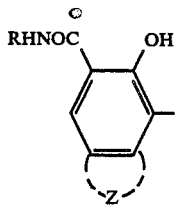

wherein Z is a group of atoms necessary to form a substituted or unsubstituted carbocyclic aromatic ring, a substituted or unsubstituted heterocyclic aromatic ring or a unsaturated monocyclic hydrocarbon ring and R represents an aryl group containing one or two $CF_3$ groups and $Cp_2$ is a coupler residue different from said $Cp_1$ and is selected from the group consisting of those which have the following formulas (a)–(f):

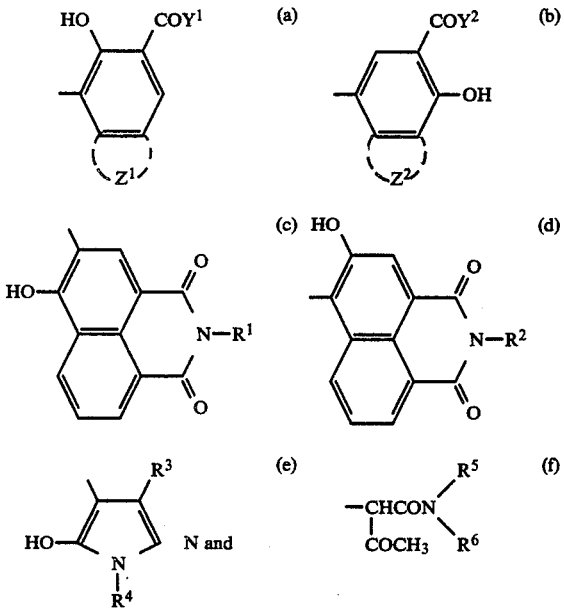

In the above formulas, $Z^1$ and $Z^2$ each is a group of atoms necessary to form a substituted or unsubstituted aromatic hydrocarbon ring or substituted or unsubstituted heterocyclic ring, $R^1$ and $R^2$ each is substituted or unsubstituted alkyl, aralkyl, aryl or heterocyclic ring group, $R^3$ is an alkyl or carboxyl group or an ester thereof, $R^4$ and $R^6$ is a substituted or unsubstituted aryl or heterocyclic ring group and $R^5$ is H, a substituted or unsubstituted alkyl, aralkyl, aryl or heterocyclic ring group and $Y^1$ and $Y^2$ each is $-NR^7R^8$, $-OR^9$, $-NHN{=}CH-R^{10}$ or $-NHNR^{11}R^{12}$ wherein $R^7$, $R^8$, $R^9$, $R^{11}$ and $R^{12}$ is H, substituted or unsubstituted alkyl, aralkyl, aryl or heterocyclic ring group and $R^{10}$ is a substituted or unsubstituted aryl or heterocyclic ring group;

General formula (II):

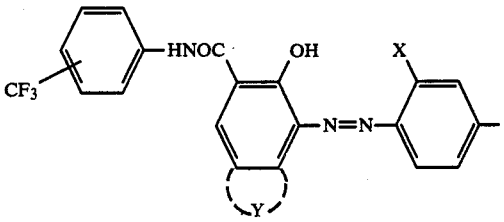

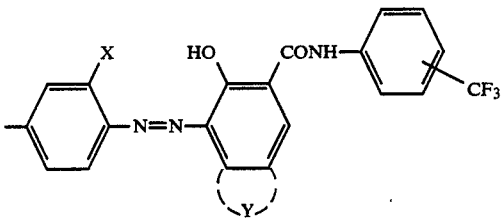

wherein X is H, a halogen atom, a lower alkyl group, methoxy group or nitro group and Y is an aromatic ring or heterocyclic ring which may be substituted;

General formula (III):

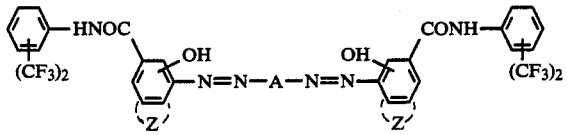

wherein A is a divalent residue which bonds through C atoms to N atoms which constitute azo and Z is a group of atoms necessary to form a substituted or unsubstituted carbocyclic-aromatic ring, a substituted or unsubstituted heterocyclic aromatic ring or unsaturated monocyclic hydrocarbon ring.

2. An electrophotographic sensitive material according to claim 1 wherein the light-sensitive layer additionally contains a charge transport substance.

3. An electrophotographic sensitive material according to claim 1 wherein the light-sensitive layer comprises a charge generation layer containing the azo compound and a charge transport layer containing a charge transport substance.

4. An electrophotographic sensitive material according to claim 1 wherein the light-sensitive layer contains a binder for the azo compound.

5. An electrophotographic sensitive material according to claim 1 wherein the light-sensitive layer additionally contains a sensitizer and/or a plasticizer.

6. An electrophotographic sensitive material according to claim 1 which has an adhesive layer, an intermediate layer or an insulating layer.

* * * * *